US010293908B2

(12) United States Patent
Noguchi et al.

(10) Patent No.: US 10,293,908 B2
(45) Date of Patent: May 21, 2019

(54) OUTBOARD MOTOR, ENGINE STARTER, AND ENGINE STARTING METHOD

(71) Applicant: YAMAHA HATSUDOKI KABUSHIKI KAISHA, Iwata-shi, Shizuoka (JP)

(72) Inventors: Jun Noguchi, Shizuoka (JP); Shiro Fukuda, Shizuoka (JP); Yuki Yamaguchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/118,512

(22) Filed: Aug. 31, 2018

(65) Prior Publication Data

US 2019/0071161 A1 Mar. 7, 2019

(30) Foreign Application Priority Data

Sep. 4, 2017 (JP) ..... 2017-169746

(51) Int. Cl.
*B63H 20/08* (2006.01)
*B63H 20/14* (2006.01)

(52) U.S. Cl.
CPC ..... *B63H 20/14* (2013.01)

(58) Field of Classification Search
CPC ..... B63H 20/08
See application file for complete search history.

(56) References Cited

U.S. PATENT DOCUMENTS

| | | | | |
|---|---|---|---|---|
| 2,932,292 | A * | 4/1960 | Trotter | F02N 11/12 123/179.1 |
| 3,297,010 | A * | 1/1967 | Beck | F02N 15/08 123/179.26 |
| 4,930,467 | A | 6/1990 | Masuda et al. | |
| 5,694,895 | A | 12/1997 | Tsunoda et al. | |
| 6,230,678 | B1 * | 5/2001 | Gracyalny | F02N 5/02 123/185.14 |
| 6,901,899 | B2 * | 6/2005 | Tsunoda | F02N 3/02 123/185.14 |
| 2004/0065289 | A1 * | 4/2004 | Leasure | F02N 3/02 123/185.14 |
| 2008/0078592 | A1 * | 4/2008 | Akasam | B60K 5/08 180/65.265 |
| 2009/0020092 | A1 | 1/2009 | Kishibata et al. | |
| 2009/0301425 | A1 * | 12/2009 | Sato | F02N 3/02 123/185.3 |
| 2017/0259808 | A1 * | 9/2017 | Makled | B60K 6/48 |
| 2018/0313318 | A1 * | 11/2018 | Koenen | F02P 3/051 |
| 2018/0347534 | A1 * | 12/2018 | Lebreux | F02N 3/02 |

FOREIGN PATENT DOCUMENTS

| | | | |
|---|---|---|---|
| JP | 2009-024540 | A | 2/2009 |
| JP | 5135186 | B2 | 1/2013 |
| WO | 02/066810 | A1 | 8/2002 |
| WO | 2016/152010 | A1 | 9/2016 |

* cited by examiner

*Primary Examiner* — Stephen P Avila
(74) *Attorney, Agent, or Firm* — Keating and Bennett, LLP

(57) ABSTRACT

An outboard motor performs assist control of assisting rotation of a crankshaft and performs power running rotation speed range expansion control of expanding a power running rotation speed range of a rotary electric machine in a state in which the crankshaft is rotated at a rotation speed within a cranking rotation speed range due to rotation of a rope reel.

20 Claims, 10 Drawing Sheets

ROTARY ELECTRIC MACHINE CONTROL PROCESSING

OUTBOARD MOTOR, ENGINE STARTER, AND ENGINE STARTING METHOD

CROSS REFERENCE TO RELATED APPLICATIONS

This application claims the benefit of priority to Japanese Patent Application No. 2017-169746 filed on Sep. 4, 2017. The entire contents of this application are hereby incorporated herein by reference.

BACKGROUND OF THE INVENTION

1. Field of the Invention

The present invention relates to an outboard motor including a rope reel, an engine starter including a manual starter, and an engine starting method.

2. Description of the Related Art

An outboard motor including a rope reel is known in general. Such an outboard motor is disclosed in Japanese Patent No. 5135186, for example.

Japanese Patent No. 5135186 discloses an outboard motor including a rope reel including a rope winder around which a rope for starting an engine is wound. This outboard motor includes an accumulation power spring that accumulates the rotational force of the rope reel and transmits the rotational force to a crankshaft. In this outboard motor, the rope is pulled a plurality of times by an operator such that the rope reel rotates, and force is gradually accumulated in the accumulation power spring. Furthermore, in this outboard motor, when the force accumulated in the accumulation power spring exceeds a resistance on the compression stroke of the engine, a piston connected to the crankshaft moves beyond a top dead center, and the engine is started. That is, in this outboard motor, the rope is pulled (preliminary operation) in order to accumulate in advance force in the accumulation power spring before the engine is started such that a load required to pull the rope at the time of starting the engine is decreased.

However, in the outboard motor disclosed in Japanese Patent No. 5135186, before the engine is started, the preliminary operation is required to accumulate in advance at least a predetermined amount of force in the accumulation power spring. Thus, in the outboard motor disclosed in Japanese Patent No. 5135186, the work burden of starting the engine on the operator increases. In addition, in the outboard motor disclosed in Japanese Patent No. 5135186, a load is required to wind the accumulation power spring, and thus the total load including a load required to perform the preliminary operation and the load required to pull the rope at the time of starting the engine is larger than a load of the resistance on the compression stroke of the engine. Thus, also from this point, the work burden on the operator increases.

Therefore, in order to decrease the work burden of starting the engine, a motor that starts the engine with electric power in a battery is conceivably provided in the outboard motor without providing the accumulation power spring. Here, a conventional outboard motor includes a fuel injector and an igniter that operate with electric power from a battery in order to start and drive an engine. Therefore, in the conventional outboard motor, it is necessary to ensure the amount of power remaining in the battery is at least enough to operate a fuel injector and an igniter. In other words, in the conventional outboard motor (engine starter, engine starting method), it is important to keep a close watch on the amount of power remaining in the battery and maintain a state in which the engine is reliably and quickly started.

SUMMARY OF THE INVENTION

Preferred embodiments of the present invention provide outboard motors, engine starters, and engine starting methods that maintain a state in which an engine is reliably and quickly started while decreasing the work burden of starting the engine, and operate fuel injection actuators to start the engine even when the amount of power remaining in the battery is not enough to assist an operator to start the engine.

An outboard motor according to a preferred embodiment of the present invention includes an engine including a crankshaft and that starts when the crankshaft is rotated at a cranking rotation speed or higher, a rope reel around which a rope is wound and connected to the crankshaft, a rotary electric machine connected to the crankshaft, and a rotary electric machine controller configured or programmed to control the rotary electric machine. The rotary electric machine controller is configured or programmed to, in a state in which the crankshaft is rotated at a rotation speed within a cranking rotation speed range including the cranking rotation speed due to rotation of the rope reel, perform assist control of assisting rotation of the crankshaft by the rotary electric machine and perform power running rotation speed range expansion control of expanding a power running rotation speed range of the rotary electric machine. In this description, the expression "assisting by the rotary electric machine" indicates that in a state in which the rope is pulled to rotate the rope reel and rotate the crankshaft, the rotary electric machine applies a rotational force to the crankshaft. The term "cranking" indicates that the crankshaft starts to rotate from a stopped state. The term "cranking rotation speed" indicates the lower limit of the rotation speed of the crankshaft at which initial explosion of the engine is possible. The term "initial explosion" indicates that the crankshaft starts to rotate from a stopped state, and fuel is initially burned. The "power running rotation speed range" is a range of the rotation speed of the crankshaft within which electric power is supplied from a battery to the rotary electric machine.

In an outboard motor according to a preferred embodiment of the present invention, the rotary electric machine controller is configured or programmed to perform the assist control of assisting rotation of the crankshaft by the rotary electric machine in a state in which the crankshaft is rotated at the rotation speed within the cranking rotation speed range due to rotation of the rope reel. Accordingly, when an operator pulls the rope to rotate the rope reel, the rotary electric machine assists in rotation of the crankshaft, and thus a torque from the rotary electric machine is applied to the crankshaft, and a force (load) of pulling the rope required to exceed a resistance on the compression stroke of the engine is decreased. In addition, unlike the case in which an accumulation power spring is provided, a preliminary operation of winding an accumulation power spring in advance is not necessary, and thus the work burden of starting the engine on the operator is decreased.

Here, in a conventional outboard motor, a force of pulling a rope may be relatively small depending on an operator when an engine is started by pulling the rope. In this case, the rotation speed of the crankshaft does not sufficiently increase, and the in-cylinder pressure of the engine may not be sufficiently achieved in order to generate initial explosion in the engine. In such a case, the operator needs to pull the rope a plurality of times. On the other hand, according to preferred embodiments of the present invention, the rotary electric machine assists in rotation of the crankshaft such that even when the force of the operator to pull the rope is relatively small, the rotation speed of the crankshaft is increased. Consequently, the in-cylinder pressure of the engine is increased due to the increased rotation speed of the crankshaft, and thus the possibility that initial explosion occurs in the engine is increased, and the engine is more reliably started.

As described above, the rotary electric machine controller is configured or programmed to perform the power running rotation speed range expansion control of expanding the power running rotation speed range of the rotary electric machine in a state in which the crankshaft is rotated at the rotation speed within the cranking rotation speed range. Accordingly, when the rotary electric machine is designed such that the induced voltage value of the rotary electric machine exceeds the output voltage value of the battery within the cranking rotation speed range, that is, even when the upper limit value of the cranking rotation speed range is larger than the upper limit value of the power running rotation speed range, the power running rotation speed range is expanded by the power running rotation speed range expansion control such that the rotary electric machine performs the power running operation. Consequently, when the power running rotation speed range expansion control is not performed, electric power is returned from the rotary electric machine to the battery within the cranking rotation speed range, and when the power running rotation speed range expansion control is performed, the induced voltage value is lowered below the output voltage value of the battery within the cranking rotation speed range, and the assist control is performed. Consequently, even when electric power is not supplied from the battery, the operator pulls the rope to rotate the rope reel and rotate the crankshaft at the rotation speed within the cranking rotation speed range such that using the electric power returned from the rotary electric machine, a fuel injector and an igniter operate to start the engine. Therefore, a state in which the engine is reliably and quickly started is maintained while the work burden of starting the engine is decreased. That is, even in the case when the amount of power remaining in the battery is not enough to assist the operator to start the engine, the fuel injection actuators operate to start the engine.

In an outboard motor according to a preferred embodiment of the present invention, the rotary electric machine preferably includes a power generation rotation speed range, which is a range of the rotation speed of the crankshaft within which an induced voltage value is not less than an output voltage value of a battery, that overlaps with the cranking rotation speed range in a state in which the power running rotation speed range expansion control is not performed by the rotary electric machine controller, and the rotary electric machine controller is preferably configured or programmed to, in a state in which the crankshaft is rotated at the rotation speed at least within the overlapping rotation speed range, perform the power running rotation speed range expansion control to lower the induced voltage value below the output voltage value and perform the assist control. Accordingly, when the crankshaft is rotated at the rotation speed within the overlapping rotation speed range, and the power running rotation speed range expansion control is not performed, electric power is returned from the rotary electric machine to the battery. When the crankshaft is rotated at the rotation speed within the overlapping rotation speed range, and the power running rotation speed range expansion control is performed, the assist control is easily performed.

In an outboard motor according to a preferred embodiment of the present invention, the rotary electric machine controller is preferably configured or programmed to perform the assist control and the power running rotation speed range expansion control when a battery is in an assist control charge state, i.e., a sufficiently charged state in which the battery is able to perform assist control. Accordingly, when the battery is charged with electric power, and the electric power of the battery is used to assist the operator to start the engine, the power running rotation speed range of the rotary electric machine is expanded by the power running rotation speed range expansion control such that the rotary electric machine assists in rotation of the crank shaft.

In this case, when the battery is not in the assist control charge state, and the crankshaft is rotated at the rotation speed within the cranking rotation speed range due to the rotation of the rope reel, electric power is preferably regenerated from the rotary electric machine. Accordingly, when the battery is not sufficiently charged with electric power, and the assist control is not possible, the rope reel is rotated such that the crankshaft is rotated at the rotation speed within the cranking rotation speed range so as to regenerate and supply electric power to operate the fuel injector and the igniter and further to charge the battery. That is, the rope reel is rotated such that the fuel injector, etc. immediately operate with the regenerated electric power.

When the assist control is performed when the battery is in the assist control charge state, the engine preferably includes a fuel injection actuator, the outboard motor preferably further includes a drive controller configured or programmed to control driving of the fuel injection actuator, and when the battery is not in the assist control charge state, and the crankshaft is rotated at the rotation speed within the cranking rotation speed range due to the rotation of the rope reel, electric power is preferably supplied from the rotary electric machine to the fuel injection actuator and the drive controller. Accordingly, even when the battery is not in the assist control charge state, the fuel injection actuator and the drive controller are driven with the electric power regenerated from the rotary electric machine to start the engine.

When the assist control is performed when the battery is in the assist control charge state, the rotary electric machine controller is preferably configured or programmed to be activated with electric power from the rotary electric machine when the battery is not in the assist control charge state, and the crankshaft is rotated at the rotation speed within the cranking rotation speed range due to the rotation of the rope reel. Accordingly, even when the battery is not in the assist control charge state, the rope reel is rotated to activate the rotary electric machine controller. Consequently, even when the battery is not in the assist control charge state, the rotary electric machine controller is activated to appropriately control the operation of the rotary electric machine.

In a structure in which the assist control is performed when the battery is in the assist control charge state, and the rotary electric machine controller is preferably configured or programmed to perform the assist control and the power running rotation speed range expansion control when a value of a voltage supplied from the battery is equal to or larger than a predetermined voltage value as when the battery is in the assist control charge state. Accordingly, the value of the voltage supplied from the battery is compared with the predetermined voltage value such that it is easily determined whether or not the battery is in the assist control charge state, and when the battery is sufficiently charged with electric power, the assist control is performed.

In an outboard motor according to a preferred embodiment of the present invention, the rotary electric machine controller is preferably configured or programmed to start the power running rotation speed range expansion control upon a change of the rotation speed of the crankshaft from less than a first rotation speed to not less than the first rotation speed within the cranking rotation speed range when performing the assist control. Here, when the rotation speed of the crankshaft is relatively low (less than the first rotation speed), the induced voltage value generated in the rotary electric machine becomes relatively small, and thus a torque generated by the rotary electric machine when the power running rotation speed range expansion control is not performed becomes larger than a torque generated by the rotary electric machine when the power running rotation speed range expansion control is performed. In view of this point, according to preferred embodiments of the present invention, the power running rotation speed range expansion control is started upon a change of the rotation speed of the crankshaft from less than the first rotation speed to not less than the first rotation speed, and thus when the rotation speed of the crankshaft is less than the first rotation speed, the rotary electric machine is rotated to increase a torque without performing the power running rotation speed range expansion control, and when the rotation speed is not less than the first rotation speed such that the torque is decreased due to an increased induced voltage value, the rotary electric machine is rotated to increase the torque by performing the power running rotation speed range expansion control. Consequently, even when the crankshaft is rotated at any rotation speed, the torque is increased, and thus the rotary electric machine efficiently assists in rotation of the crankshaft.

In an outboard motor according to a preferred embodiment of the present invention, the rotary electric machine controller is preferably configured or programmed to, when performing the assist control, perform advance angle control on the rotary electric machine in the state in which the crankshaft is rotated at the rotation speed within the cranking rotation speed range so as to perform the power running rotation speed range expansion control to lower an induced voltage value of the rotary electric machine. Accordingly, the induced voltage value of the rotary electric machine is lowered in response to a change in the conduction phase of electric power to be supplied to the rotary electric machine, and thus the power running rotation speed range is easily expanded.

In this case, the rotary electric machine controller is preferably configured or programmed to, when performing the assist control, perform control of switching a conduction phase to the rotary electric machine from a first phase angle to a second phase angle larger than the first phase angle in the state in which the crankshaft is rotated at the rotation speed within the cranking rotation speed range so as to perform the power running rotation speed range expansion control to lower the induced voltage value. Accordingly, the conduction phase to the rotary electric machine is switched such that the induced voltage value is lowered. Therefore, the conduction phase to the rotary electric machine is advanced (switched) from the first phase angle to the second phase angle such that the power running rotation speed range expansion control is easily performed.

In an outboard motor according to a preferred embodiment of the present invention, the rotary electric machine preferably rotates with three-phase alternating current power supplied to the rotary electric machine, and the rotary electric machine controller is preferably configured or programmed to perform the assist control while supplying the three-phase alternating current power including a first conduction period of more than 120 electrical degrees to the rotary electric machine in the state in which the crankshaft is rotated at the rotation speed within the cranking rotation speed range. Accordingly, the power running rotation speed range is further expanded.

In this case, the rotary electric machine controller is preferably configured or programmed to perform the assist control while supplying the three-phase alternating current power including a second conduction period of not more than 120 electrical degrees to the rotary electric machine in a state in which the crankshaft is rotated at the rotation speed less than a second rotation speed within the cranking rotation speed range, and is preferably configured or programmed to perform the assist control while supplying the three-phase alternating current power including the first conduction period to the rotary electric machine in a state in which the crankshaft is rotated at the rotation speed not less than the second rotation speed within the cranking rotation speed range. Accordingly, when the crankshaft is rotated at the rotation speed less than the second rotation speed at which the induced voltage value is relatively small, the conduction period is set to 120 electrical degrees or less such that more efficient assist control is performed, and when the crankshaft is rotated at the rotation speed not less than the second rotation speed at which the induced voltage value is relatively large, the conduction period is changed to the first conduction period such that the power running rotation speed range is expanded, and the assist control is performed while significantly reducing or preventing a decrease in torque.

In an outboard motor according to a preferred embodiment of the present invention, the rotary electric machine controller is preferably configured or programmed to, in a state in which the crankshaft is rotated at the rotation speed larger than the cranking rotation speed range, stop the power running rotation speed range expansion control and perform power generation control. Accordingly, when the engine is started and the crankshaft is rotated at the rotation speed larger than the cranking rotation speed range, the output voltage value of the battery is constant, and thus electric power is appropriately supplied to engine auxiliaries including the fuel injector and the igniter while the battery is charged.

An outboard motor according to a preferred embodiment of the present invention preferably further includes a rotation angle acquirer that acquires a rotation angle of the rotary electric machine. Accordingly, the rotation angle necessary for conduction control of the rotary electric machine and detected by the rotation angle acquirer is diverted to the power running rotation speed range expansion control and the assist control. Consequently, it is not necessary for the operator to perform an input operation when the assist control is started, and thus an operation of starting the engine becomes simpler.

In an outboard motor according to a preferred embodiment of the present invention, the rotary electric machine controller is preferably configured or programmed to, after the rotation speed of the crankshaft exceeds a rotation speed of the rope reel, continue to perform the power running rotation speed range expansion control and perform control of supplying electric power from a battery to the rotary electric machine to rotate the crankshaft. Here, as described above, in a conventional outboard motor, in the first compression stroke of an engine, initial explosion may not be reached, and the engine is not likely to start. Therefore, in a conventional outboard motor, the length of a rope is relatively increased such that the compression stroke of the engine is reached a plurality of times while the rope is pulled once, and in any of the reached compression strokes, initial explosion is caused to occur. On the other hand, according to preferred embodiments of the present invention, the rotary electric machine controller is configured or programmed to, after the rotation speed of the crankshaft exceeds the rotation speed of the rope reel, continue to perform the power running rotation speed range expansion control and perform control of rotating the crankshaft, and thus even when the operator cannot perform a cranking operation enough to start the engine, the engine is started while the crankshaft is continuously rotated by the rotary electric machine. Consequently, the length of the rope is decreased.

In an outboard motor according to a preferred embodiment of the present invention, the engine preferably includes a fuel injector and an igniter, and the rotary electric machine controller is preferably configured or programmed to, at least until fuel injection by the fuel injector is completed and initial ignition by the igniter is completed, continue to perform the power running rotation speed range expansion control and perform control of supplying electric power from a battery to the rotary electric machine in the state in which the crankshaft is rotated at the rotation speed within the cranking rotation speed range. Accordingly, the rotary electric machine assists in rotation of the crankshaft at least until ignition is performed in the engine, and thus the engine is more reliably started.

In an outboard motor according to a preferred embodiment of the present invention, the rotary electric machine preferably includes a rotor directly connected to the crankshaft and a stator that faces the rotor in a radial direction of the crankshaft. Accordingly, unlike the case in which the rotor of the rotary electric machine and the crankshaft are not directly connected to each other, as the case in which a gear or the like is provided between the rotary electric machine and the crankshaft, a complicated configuration of the outboard motor is significantly reduced or prevented. Furthermore, with the above configuration, an existing rotary electric machine provided in a conventional outboard motor is usable as the rotary electric machine that assists in rotation of the crankshaft.

An outboard motor according to a preferred embodiment of the present invention preferably further includes a battery disposed in an outboard motor body, that supplies electric power to the rotary electric machine, and to which the electric power is returned from the rotary electric machine. Accordingly, there is no need to provide a power line through which electric power is exchanged between a marine vessel (vessel body) and the outboard motor unlike the case in which electric power is supplied from the battery provided in the marine vessel to the rotary electric machine. Consequently, the structure that connects the outboard motor to the marine vessel is simplified.

An engine starter according to a preferred embodiment of the present invention includes a manual starter connected to a crankshaft of an engine that starts when the crankshaft is rotated at a cranking rotation speed or higher and that manually rotates the crankshaft, a rotary electric machine connected to the crankshaft, and a rotary electric machine controller configured or programmed to control the rotary electric machine. The rotary electric machine controller is configured or programmed to, in a state in which the crankshaft is rotated at a rotation speed within a cranking rotation speed range including the cranking rotation speed by the manual starter, perform assist control of assisting rotation of the crankshaft by the rotary electric machine and perform power running rotation speed range expansion control of expanding a power running rotation speed range of the rotary electric machine.

An engine starter according to a preferred embodiment of the present invention maintains a state in which the engine is reliably and quickly started while decreasing the work burden of starting the engine. In addition, the engine starter operates a fuel injection actuator to start the engine even in the case when the amount of power remaining in the battery is not enough to assist an operator to start the engine.

An engine starting method according to a preferred embodiment of the present invention for an engine that starts when a crankshaft is rotated at a cranking rotation speed or higher, includes rotating the crankshaft by a manual starter connected to the crankshaft, and performing assist control of assisting rotation of the crankshaft by a rotary electric machine connected to the crankshaft and performing power running rotation speed range expansion control of expanding a power running rotation speed range of the rotary electric machine in a state in which the crankshaft is rotated at a rotation speed within a cranking rotation speed range including the cranking rotation speed by the manual starter.

An engine starting method according to a preferred embodiment of the present invention as described above maintains a state in which the engine is reliably and quickly started while decreasing the work burden of starting the engine. In addition, the engine starting method operates a fuel injection actuator to start the engine even in the case when the amount of power remaining in the battery is not enough to assist an operator to start the engine.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of an outboard motor 100 according to preferred embodiments of the present invention is now described with reference to FIGS. 1 to 9. In the following description, the terms "front" and "forward movement direction" represent a direction FWD in FIG. 1, and the terms "rear" and "rearward movement direction" represent a direction BWD in FIG. 1. The outboard motor 100 is an example of an "engine starter".

Figure 1:
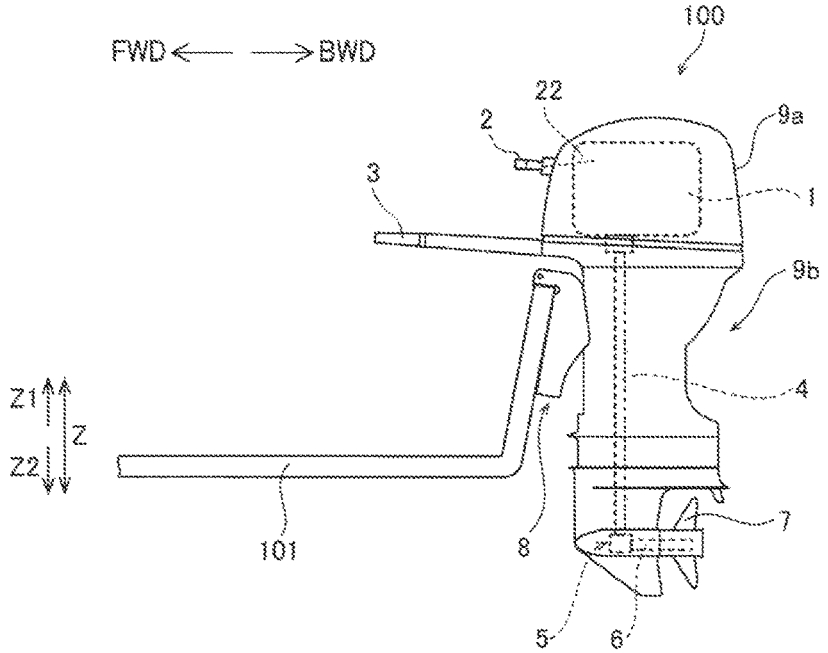
FIG. 1 is a side view showing the overall structure of an outboard motor according to a preferred embodiment of the present invention.

As shown in FIG. 1, the outboard motor 100 is attached to a rear portion of a vessel body 101. The outboard motor 100 includes an engine 1, a puller 2, a tiller handle 3, a drive shaft 4, a gear 5, a propeller shaft 6, a propeller 7, and a bracket 8. The outboard motor 100 is attached to the vessel body 101 by the bracket 8.

As shown in FIG. 1, the outboard motor 100 includes a cowling 9*a* and a case 9*b* provided below the cowling 9*a*. The engine 1 is housed in the cowling 9*a*. The puller 2 protrudes from the cowling 9*a* in the forward movement direction. The tiller handle 3 protrudes from the cowling 9*a* in the forward movement direction below (on the arrow Z2 direction side of) the puller 2. The drive shaft 4, the gear 5, and the propeller shaft 6 are disposed inside the case 9*b*. The propeller 7 is disposed on the lower side inside the case 9*b*. The bracket 8 is disposed on the forward movement direction side of the case 9*b*. The cowling 9*a* and the case 9*b* are examples of an "outboard motor body".

The engine 1 is an internal combustion engine driven by explosive combustion of gasoline, light oil, or the like. For example, the engine 1 is a four-stroke engine that repeats an exhaust stroke, an intake stroke, a compression stroke, and an expansion stroke.

Figure 2:
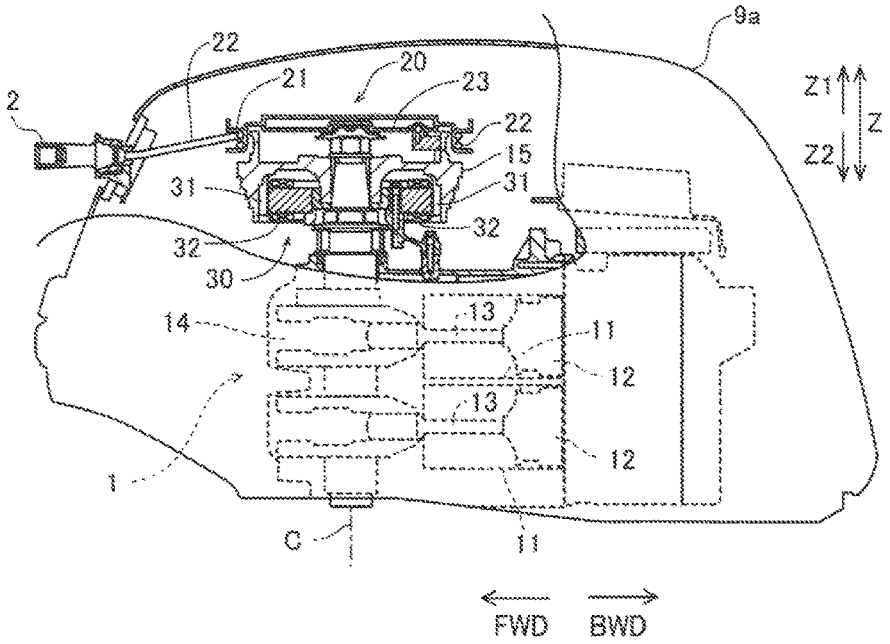
FIG. 2 is a schematic view showing the structure of an outboard motor according to a preferred embodiment of the present invention.

As shown in FIG. 2, the engine 1 includes a plurality of cylinders 11 aligned in an upward-downward direction (direction Z), pistons 12 that horizontally reciprocate in the cylinders 11, respectively, connecting rods 13 connected to the pistons 12, and a crankshaft 14 connected to the connecting rods 13 and that extends in the upward-downward direction. The horizontal reciprocating movement of the pistons 12 is converted into a rotational motion by the connecting rods 13 and the crankshaft 14. The lower end of the crankshaft 14 is connected to the drive shaft 4 (see FIG. 1). The upper end of the crankshaft 14 is connected to a flywheel magneto 15 (hereinafter referred to as the "FWM 15") that stabilizes rotation of the engine 1. The FWM 15 is an example of a "rotor".

Figure 3:
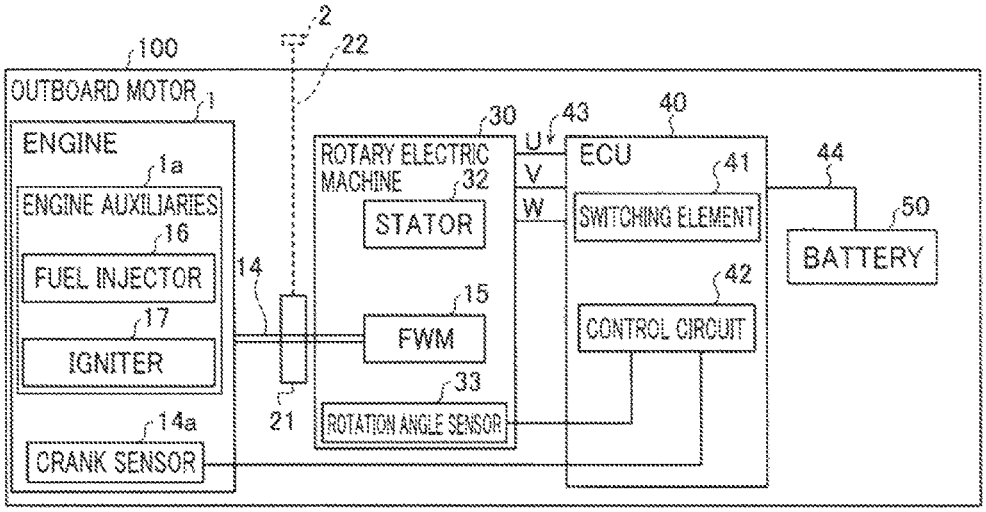
FIG. 3 is a block diagram of an outboard motor according to a preferred embodiment of the present invention.

As shown in FIG. 3, the engine 1 includes engine auxiliaries 1*a*. The engine auxiliaries 1*a* include fuel injection actuators (FI). For example, the engine auxiliaries 1*a* include a fuel injector 16, an igniter 17, etc. In the engine 1, based on commands from an ECU 40 described below, for example, fuel is injected by the fuel injector 16 during the exhaust stroke, mixed gas of the injected fuel and air is introduced into the cylinders 11 during the intake stroke, the introduced fuel is ignited and burned by the igniter 17 during the compression stroke, and the pistons 12 in the cylinders 11 move during the expansion stroke (see FIG. 9). The fuel injector 16 and the igniter 17 operate using electric power supplied from a battery 50 or electric power regenerated (returned) from a rotary electric machine 30. The fuel injector 16 and the igniter 17 are examples of a "fuel injection actuator". The fuel injection actuator related to FI may include a fuel pump, an injector, and an idle speed control (ISC) motor, for example.

As shown in FIG. 2, inside the cowling 9*a* of the outboard motor 100, a manual starter 20 that manually starts the engine 1 is disposed above the FWM 15 of the engine 1. The manual starter 20 is connected to the crankshaft 14 and rotates the crankshaft 14 by human power. In other words, the manual starter 20 is a recoil starter and is a pull starter.

Specifically, the manual starter 20 includes a rope reel 21 rotatable around a rotation center axis C (hereinafter referred to as the "axis C") of the crankshaft 14, and a rope 22, one end of which is connected to the rope reel 21 and the other end of which is connected to the puller 2, and wound around the rope reel 21. The puller 2 is pulled by an operator such that the rope reel 21 is rotated around the axis C.

Figure 5:
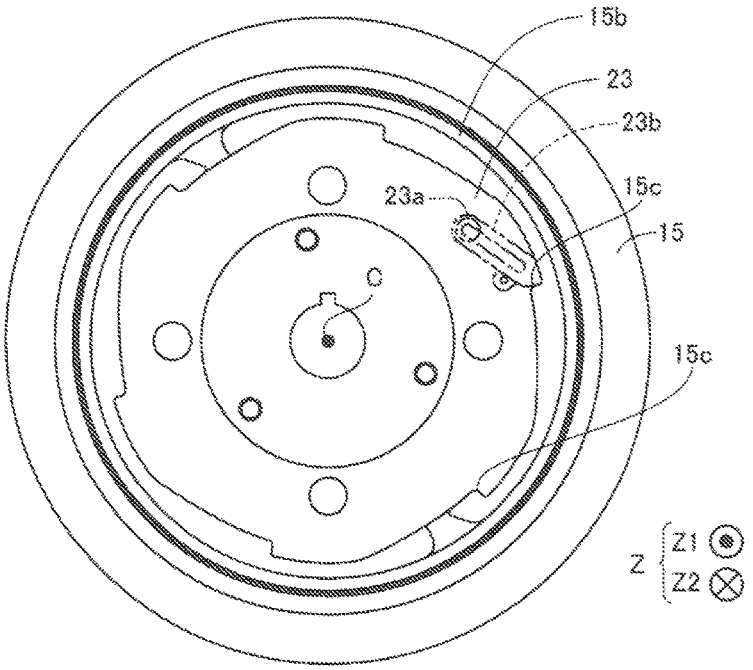
FIG. 5 is a diagram showing the structure of a cam plate and a flywheel magneto of an outboard motor according to a preferred embodiment of the present invention.

As shown in FIG. 5, the manual starter 20 includes a cam plate 23 rotatable around the axis C. The cam plate 23 includes an engagement pawl 23*b* rotatable around a rotation shaft 23*a*. A cylindrical protrusion 15*b* is provided on an upper portion (portion in an arrow Z1 direction) of the FWM 15, and a plurality of engagement recesses 15*c* are provided on the inner surface of the protrusion 15*b*. When the engine 1 is manually started, the engagement pawl 23*b* is caught in the engagement recesses 15*c* such that the rotational force of the manual starter 20 (rope reel 21) is transmitted to the FWM 15. The rotational force is transmitted from the FWM 15 to the crankshaft 14, and the crankshaft 14 rotates such that the pistons 12 horizontally move via the connecting rods 13.

The manual starter 20 is constructed such that when the rotation speed of the FWM 15 (crankshaft 14) exceeds the rotation speed of the rope reel 21, the engagement pawl 23*b* and the engagement recesses 15*c* disengage from each other, and torque transmission between the FWM 15 and the rope reel 21 is stopped. When the operation of pulling the rope 22 is stopped, or when the engine 1 is started and the rotation speed of the crankshaft 14 increases, for example, torque transmission from the rope reel 21 to the FWM 15 is stopped.

As shown in FIG. 3, the outboard motor 100 (the cowling 9*a* or the case 9*b*) includes the rotary electric machine 30, an inverter with a built-in controller (ECU: Engine Control Unit) 40 (hereinafter referred to as the "ECU 40"), the battery 50, and a crank sensor 14*a*. The ECU 40 is an example of a "rotary electric machine controller" or a "drive controller".

As requirements of an engine control crank signal, it is necessary to detect a reference angle once per rotation of the crankshaft 14 (FWM 15), and a predetermined angular resolution (about 30 degrees, for example) is required to determine a crank angle. For example, the crank sensor 14*a* detects a protrusion (not shown) provided on the outer periphery of a rotor (FWM 15) of the rotary electric machine 30. Specifically, one protrusion is provided on the outer periphery of the rotor, and in the outboard motor 100, a low-level signal is output from the crank sensor 14*a* that has detected the protrusion (see FIG. 12). That is, the crank sensor 14*a* outputs a low-level signal once per rotation of the FWM 15. A rotation angle sensor 33 described below has the predetermined angular resolution (about 30 degrees, for example) sufficient to determine the crank angle, and thus a signal from the crank sensor 14*a* and a signal from the rotation angle sensor 33 are combined such that the ECU 40 controls the engine 1. The crank sensor 14*a* is provided in the engine 1.

As shown in FIG. 2, the rotary electric machine 30 includes the FWM 15, on which a plurality of permanent magnets 31 are disposed, directly connected to the crankshaft 14, and stators 32 (winding) that face the permanent magnets 31 in the radial direction of the crankshaft 14. The permanent magnets 31 are fixed to the inner peripheral surface of the FWM 15, for example. As shown in FIG. 3, the rotary electric machine 30 includes the rotation angle sensor 33, acquires a change in the rotation angle of the FWM 15 (permanent magnets 31), and transmits the change to a control circuit 42 of the ECU 40. The rotation angle sensor 33 includes a Hall element, for example, and has the predetermined angular resolution (about 30 degrees, for example). The rotation angle sensor 33 is an example of a "rotation angle acquirer".

Figure 6:
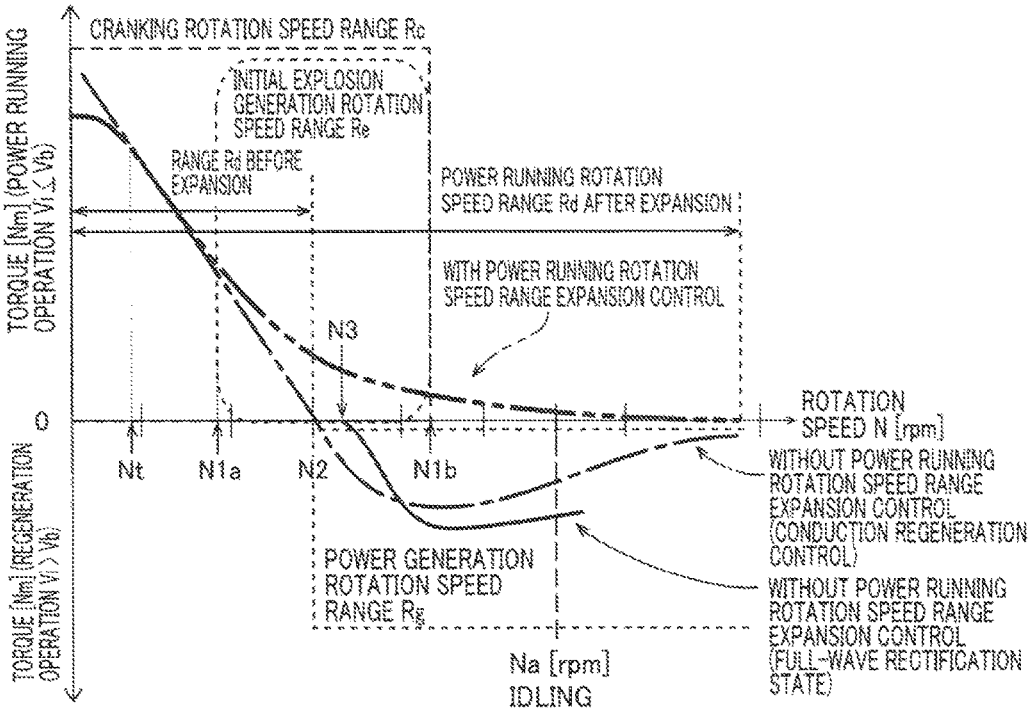
FIG. 6 is a diagram showing the characteristics of a rotary electric machine of an outboard motor according to a preferred embodiment of the present invention.

As shown in FIG. 6, the rotary electric machine 30 defines and functions as a generator that returns an induced voltage generated by rotation of the FWM 15 to the battery 50, and defines and functions as a motor that rotates with electric power supplied from the battery 50 to rotate the crankshaft 14. For example, three-phase (U phase, V phase, and W phase) alternating current power is supplied to the rotary electric machine 30 such that the rotary electric machine 30 rotates. That is, the rotary electric machine 30 is an integrated starter generator (ISG).

Specifically, the rotary electric machine 30 includes a power generation rotation speed range Rg, which is a range of the rotation speed N of the crankshaft 14 within which an induced voltage value Vi is not less than the output voltage value Vb of the battery 50, that overlaps with a cranking rotation speed range Rc in a state in which power running rotation speed range expansion control of expanding a power running rotation speed range Rd of the rotary electric machine 30 is not performed by the ECU 40. In other words, the rotation speed N of the crankshaft 14 is an engine rotation speed. The "power running rotation speed range expansion control" is described below in detail.

Specifically, the cranking rotation speed range Rc is a range of the rotation speed N of the crankshaft 14 when the engine 1 is cranked. That is, the cranking rotation speed range Rc includes an initial explosion generation rotation speed range Re, which is a range of the rotation speed N of the crankshaft 14 within which initial explosion is possible in the engine 1. The initial explosion generation rotation speed range Re is a range from a lower limit rotation speed N1*a* to an upper limit rotation speed N1*b*, for example. Furthermore, an idling rotation speed Na, which is the rotation speed N of the crankshaft 14 during the idling operation of the engine 1, is higher than the rotation speed N1*b*. Note that the term "cranking" indicates that the crankshaft 14 starts to rotate from a stopped state. The lower limit rotation speed N1*a* of the initial explosion generation rotation speed range Re is an example of a "cranking rotation speed".

In the rotary electric machine 30, the induced voltage value Vi increases as the rotation speed N increases. In the rotary electric machine 30, the output voltage value Vb of the battery 50 and the induced voltage value Vi are equal or substantially equal to each other when the rotation speed N of the crankshaft 14 is N2. The rotation speed N2 is a range of not less than the rotation speed N1*a* and not more than the rotation speed N1*b*.

When the rotation speed N of the crankshaft 14 is higher than N2 (power generation rotation speed range Rg) in a state in which the power running rotation speed range expansion control described below is not performed and control at a first phase angle (about 0 degrees, for example) with 120-degree conduction is performed (hereinafter referred to as the "conduction regeneration control"), the induced voltage value Vi becomes larger than the output voltage value Vb of the battery 50, and electric power from the rotary electric machine 30 is returned to the battery 50. That is, the rotary electric machine 30 has characteristics that the cranking rotation speed range Rc and the power generation rotation speed range Rg overlap with each other in a rotation speed range of not less than the rotation speed N2 and not more than the rotation speed N1*b*.

When the rotation speed N of the crankshaft 14 is higher than N3 (power generation rotation speed range Rg) in a state in which the power running rotation speed range expansion control is not performed and the switching operation is not performed by switching elements 41 but body diodes on the switching elements 41 perform rectification (hereinafter referred to as the "full-wave rectification state"), the induced voltage value Vi becomes larger than the output voltage value Vb of the battery 50, and electric power from the rotary electric machine 30 is returned to the battery 50. That is, the rotary electric machine 30 has characteristics that the cranking rotation speed range Rc and the power generation rotation speed range Rg overlap with each other in a rotation speed range of not less than the rotation speed N3 and not more than the rotation speed N1*b*. For example, the rotation speed N3 is higher than the rotation speed N2.

Figure 7:
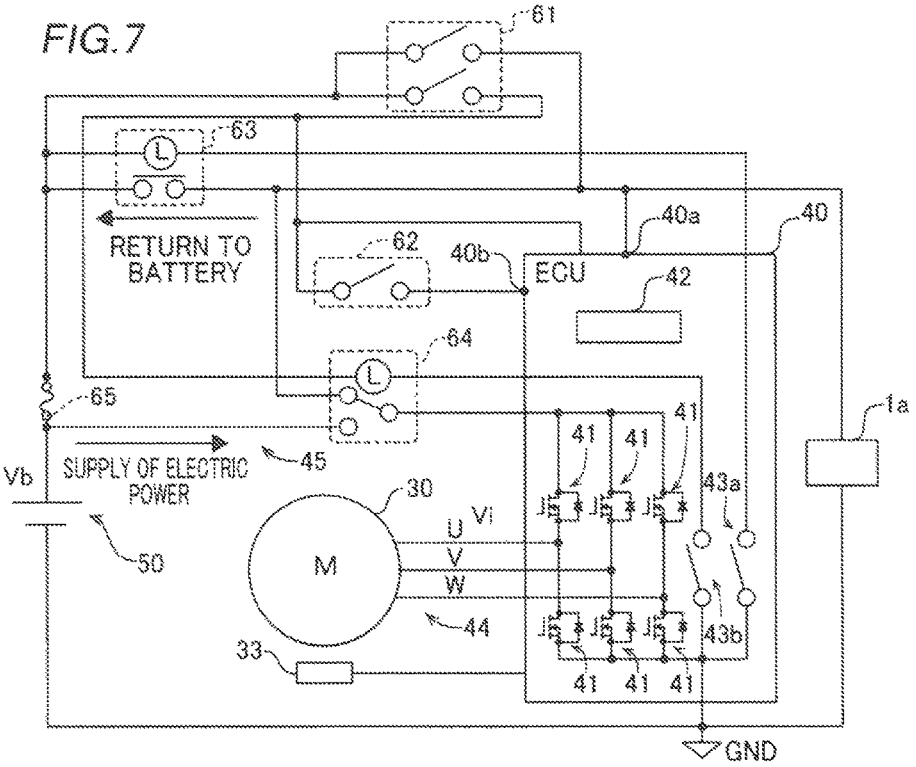
FIG. 7 is a circuit diagram showing connections between an ECU and a battery of an outboard motor according to a preferred embodiment of the present invention.

As shown in FIG. 7, the outboard motor 100 includes a main switch 61 provided between the ECU 40 and the battery 50 and a start switch 62 provided between the main switch 61 and the ECU 40. When the operation of the outboard motor 100 is started, for example, the main switch 61 is turned on (is conductive), and a power supply terminal 40*a* of the ECU 40 and the battery 50 are connected to each other. When the main switch 61 is turned on, electric power is supplied from the battery 50 to the engine auxiliaries 1*a* of the engine 1.

In the outboard motor 100, when the battery 50 is not in an assist control charge state, and the crankshaft 14 is rotated at the rotation speed N within the cranking rotation speed range Rc due to rotation of the rope reel 21, electric power from the rotary electric machine 30 is supplied to the fuel injector 16 and the ECU 40. That is, when the outboard motor 100 is in a charge state in which the conduction regeneration control is possible, the ECU 40 supplies the electric power from the rotary electric machine 30 to the engine auxiliaries 1*a* by the conduction regeneration control. When the outboard motor 100 is not in a charge state in which the conduction regeneration control is possible, the ECU 40 is in the full-wave rectification state, and the electric power from the rotary electric machine 30 is supplied to the engine auxiliaries 1*a* and the ECU 40. For example, in the outboard motor 100, the electric power from the rotary electric machine 30 is supplied to the fuel injector 16 in the engine 1 via a start relay 64 described below.

When the start switch 62 is turned on, a start switch signal is input to a start terminal 40*b* of the ECU 40. When the start switch signal is input and the ECU 40 acquires a change in the rotation angle from the rotation angle sensor 33, the ECU 40 performs assist control (and the power running rotation speed range expansion control).

The outboard motor 100 includes a main relay 63 provided between the ECU 40 and the battery 50, the start relay 64 provided between the main switch 61 and the ECU 40, the start switch 62 provided between the main relay 61 and the ECU 40, and a protective component 65.

The ECU 40 includes a switch 43*a* that switches between a state in which an exciting coil of the main relay 63 is grounded and a state in which the exciting coil is not grounded, and a switch 43*b* that switches between a state in which an exciting coil of the start relay 64 is grounded and a state in which the exciting coil is not grounded. The switches 43*a* and 43*b* operate based on commands from the control circuit 42.

As shown in FIG. 7, the ECU 40 includes a plurality of switching elements 41 and the control circuit 42 that controls the operations of the plurality of switching elements 41. Furthermore, the ECU 40 is connected to the rotary electric machine 30 by a three-phase (U phase, V phase, and W phase) power line 44 and is connected to the battery 50 by a power line 45.

The switching elements 41 each include a field effect transistor (FET), for example. Preferably, each of the switching elements 41 is an N-channel MOSFET with a body diode. The control circuit 42 performs control of performing switching operations (of switching between the conduction state (ON) and the disconnection state (OFF) of each of the three phases) by transmitting gate drive signals to the plurality of switching elements 41.

The control circuit 42 acquires information about the rotation angle from the rotation angle sensor 33 and controls the operations of the switching elements 41 based on the acquired information about the rotation angle. Specifically, the control circuit 42 sets U-phase, V-phase, and W-phase conduction periods (for example, approximately 120-degree conduction or 180-degree conduction) in synchronization with the acquired rotation angle, and performs advance angle control of setting a conduction phase to the rotary electric machine 30. When the switching elements 41 do not operate, the full-wave rectification state is established. As shown in FIG. 3, the control circuit 42 acquires information about the crank angle from the crank sensor 14*a* and controls the operations of the fuel injector 16 and the igniter 17 based on the acquired information about the crank angle. The 180-degree conduction is an example of a "first conduction period". The 120-degree conduction is an example of a "second conduction period". The conduction phase is a phase difference between the phase of the induced voltage and the phase of the conduction voltage.

Figure 8:
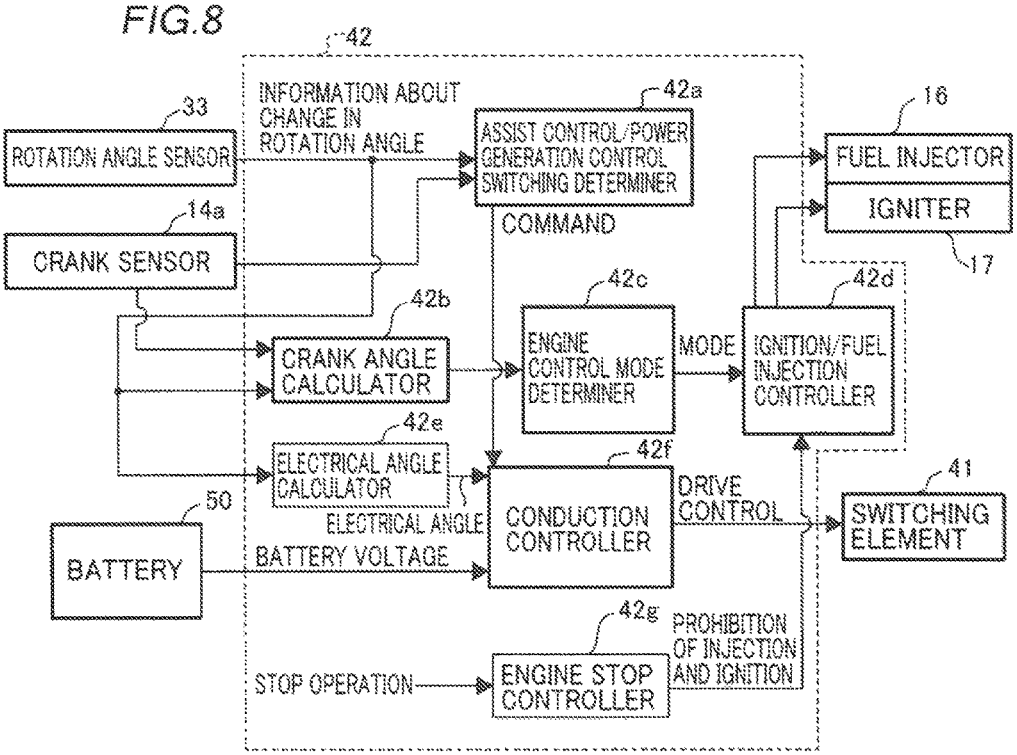
FIG. 8 is a block diagram showing the structure of a control circuit of an outboard motor according to a preferred embodiment of the present invention.

Specifically, as shown in FIG. 8, the control circuit 42 includes an assist control/power generation control switching determiner 42*a* (hereinafter referred to as the "switching determiner 42*a*"), a crank angle calculator 42*b*, an engine control mode determiner 42*c* (hereinafter referred to as the "mode determiner 42*c*"), an ignition/fuel injection controller 42*d*, an electrical angle calculator 42*e*, a conduction controller 42*f*, and an engine stop controller 42*g*.

The switching determiner 42*a* acquires the information about a change in the rotation angle from the rotation angle sensor 33 and the information from the crank sensor 14*a* to acquire the rotation speed N of the crankshaft 14 and switches the conduction phase or the conduction system based on the acquired rotation speed N. Commands from the switching determiner 42*a* are input to the conduction controller 42*f*.

Figure 9:
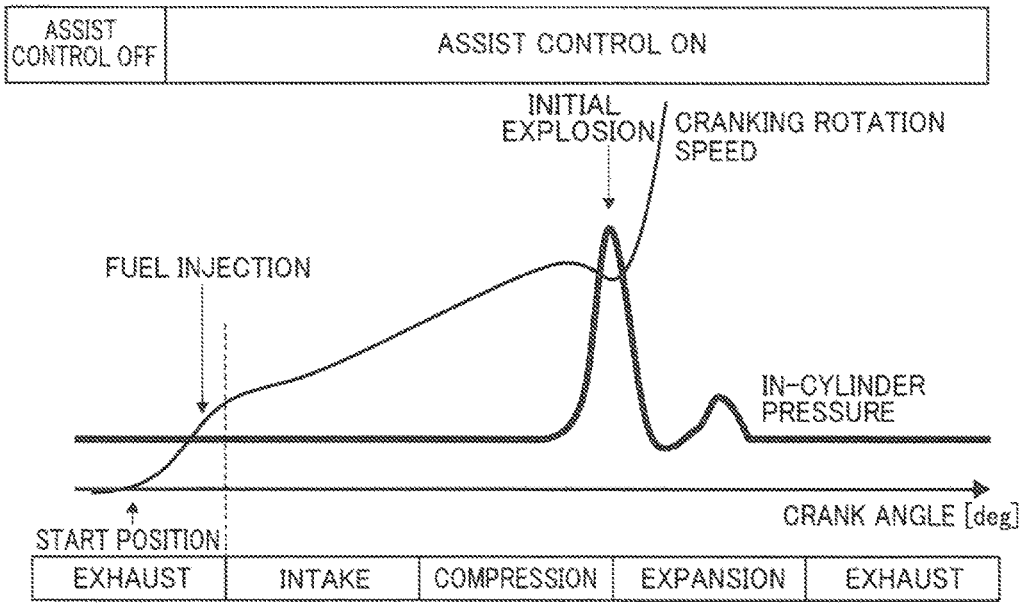
FIG. 9 is a diagram illustrating initial explosion of an outboard motor according to a preferred embodiment of the present invention.

As shown in FIG. 9, the switching determiner 42*a* determines whether or not to perform assist control of assisting rotation of the crankshaft 14 by the rotary electric machine 30 upon detection of a change in the output state of the rotation angle sensor 33 due to change from a state in which the crankshaft 14 stops to a state in which the crankshaft 14 rotates. According to preferred embodiments of the present invention, the expression "assisting by the rotary electric machine 30" indicates that in a state in which the operator pulls the rope 22 to rotate the rope reel 21 and rotate the crankshaft 14, the rotary electric machine 30 inputs a rotational force to the crankshaft 14. The "assist control" is described below in detail.

Specifically, when the battery 50 is in the assist control charge state, the switching determiner 42*a* performs the assist control of assisting rotation of the crankshaft 14 by the rotary electric machine 30 in a state in which the crankshaft 14 is rotated at the rotation speed N within the cranking rotation speed range Rc due to rotation of the rope reel 21, and when the battery 50 is not in the assist control charge state, the switching determiner 42*a* does not perform the assist control.

Here, the switching determiner 42*a* performs the assist control when the output voltage value Vb supplied from the battery 50 is equal to or more than a reference voltage value Vt when the battery 50 is in the assist control charge state. For example, as shown in FIG. 7, the switching determiner 42*a* compares the output voltage value Vb of the battery 50 supplied from the battery 50 to the power supply terminal 40*a* via the main switch 61 with the reference voltage value Vt. The switching determiner 42*a* starts the assist control when the output voltage value Vb is equal to or more than the reference voltage value Vt, and does not perform the assist control when the output voltage value Vb is less than the reference voltage value Vt. The reference voltage value Vt is an example of a "predetermined voltage value".

As shown in FIG. 6, the switching determiner 42*a* starts the power running rotation speed range expansion control when the switching determiner 42*a* performs the assist control, and the rotation speed N of the crankshaft 14 changes from less than a predetermined switching rotation speed Nt to not less than the switching rotation speed Nt. The switching rotation speed Nt is set as a rotation speed at which the magnitude of a torque generated when the power running rotation speed range expansion control is performed is equal to or larger than the magnitude of a torque generated when the power running rotation speed range expansion control is not performed, for example. The switching rotation speed Nt is an example of a "first rotation speed" or a "second rotation speed".

That is, in a state in which the rotation speed N of the crankshaft 14 is at least the rotation speed N2 (rotation speed N3) and not more than the rotation speed N1*b*, which is a rotation speed within the rotation speed range in which the cranking rotation speed range Rc and the power generation rotation speed range Rg overlap with each other, the switching determiner 42*a* performs the power running rotation speed range expansion control (two-dot chain line) to lower the induced voltage value Vi below the output voltage value Vb and performs the assist control.

Regardless of whether or not the operator continues to pull the rope 22, the switching determiner 42*a* continues to perform the power running rotation speed range expansion control and perform control of supplying electric power from the battery 50 to the rotary electric machine 30 to rotate the crankshaft 14.

Figure 4:
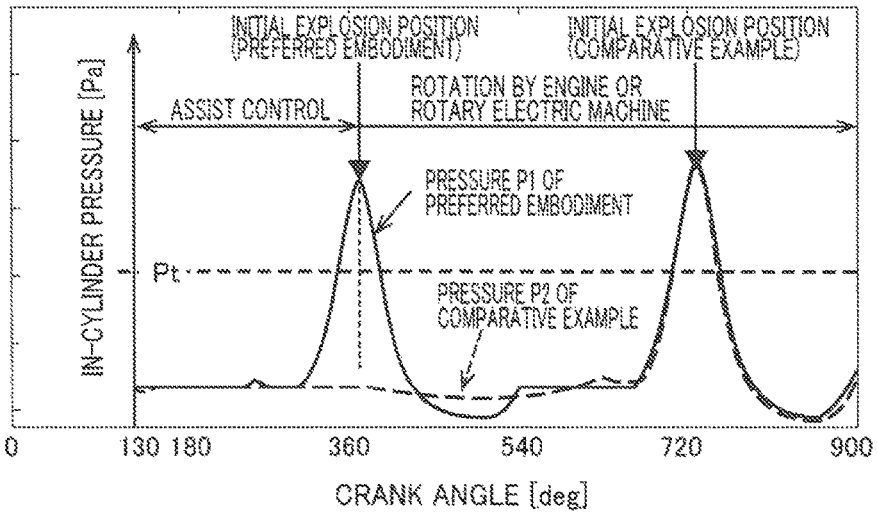
FIG. 4 is a diagram illustrating the relationship between the in-cylinder pressure of an outboard motor according to a preferred embodiment of the present invention and the in-cylinder pressure of an outboard motor according to a comparative example.

That is, even after the rotation speed N of the crankshaft 14 exceeds the rotation speed of the rope reel 21, the switching determiner 42*a* continues to perform the power running rotation speed range expansion control and perform control of supplying electric power from the battery 50 to the rotary electric machine 30 to rotate the crankshaft 14. In other words, as shown in FIG. 4, even after the rope 22 is pulled (stroked) and a torque input to the crankshaft 14 via the rope reel 21 is stopped, the switching determiner 42*a* continues to perform the power running rotation speed range expansion control and perform control of supplying electric power from the battery 50 to the rotary electric machine 30 to rotate the crankshaft 14.

According to preferred embodiments of the present invention, in a state in which the crankshaft 14 is rotated at the rotation speed N (the idling rotation speed Na, for example) larger than the cranking rotation speed range Rc, the switching determiner 42*a* stops the power running rotation speed range expansion control and performs power generation control (one-dot chain line in FIG. 6). The power generation control is described below in detail.

As shown in FIG. 8, the crank angle calculator 42*b* acquires information from the crank sensor 14*a* and the rotation angle sensor 33, calculates the crank angle and the rotation speed (rotation number) of the crankshaft 14, and transmits the calculated crank angle and speed to the mode determiner 42*c*.

The mode determiner 42*c* determines control to be performed on the fuel injector 16 and the igniter 17 included in the engine 1 based on the information acquired from the crank angle calculator 42*b*. The mode determiner 42*c* determines an engine control mode and transmits information about the determined mode to the ignition/fuel injection controller 42*d*. The ignition/fuel injection controller 42*d* determines the fuel injection timing of the fuel injector 16, the ignition timing of the igniter 17, and the like based on the information about the mode and the like. The ignition/fuel injection controller 42*d* is an example of a "drive controller".

When a state in which there is no input (edge input) from the rotation angle sensor 33 continues for a predetermined time or more, for example, the mode determiner 42*c* sets the engine control mode to an "engine stop mode". In the "engine stop mode", the ignition/fuel injection controller 42*d* controls the engine 1 to be stopped.

When acquiring a change in the rotation angle (edge input) from the rotation angle sensor 33 in the "engine stop mode", the ignition/fuel injection controller 42*d* starts to control the fuel injector 16 to inject fuel (first injection execution period) asynchronously with the operation of the crankshaft 14. When acquiring an edge input from the crank sensor 14*a*, the ignition/fuel injection controller 42*d* starts an ignition execution period, which is a period during which the igniter 17 performs ignition.

When the rotation speed N is equal to or higher than a predetermined rotation speed Ni, the mode determiner 42*c* sets the engine control mode to a "post-initial explosion completion mode". The ignition/fuel injection controller 42*d* starts to control the fuel injector 16 to inject fuel (second injection execution period) synchronously with the operation of the crankshaft 14 in the "post-initial explosion completion mode". The predetermined rotation speed Ni is a rotation speed within or above the cranking rotation speed range Rc and equal to or less than the idling rotation speed Na, for example.

The electrical angle calculator 42*e* acquires the information about the rotation angle from the rotation angle sensor 33 and calculates an electrical angle for conduction control. The electrical angle calculator 42*e* transmits the calculated electrical angle to the conduction controller 42*f*.

The conduction controller 42*f* controls the drive voltage, conduction system, conduction phase of each of the switching elements 41 based on commands from the switching determiner 42*a*. The engine stop controller 42*g* stops (prohibits) the operations of the fuel injector 16 and the igniter 17 when a stop operation (a stop flag, abnormality detection, or the like) is input. Furthermore, the engine stop controller 42*g* transmits a command signal that indicates switching between a conduction state and a non-conduction state to the conduction controller 42*f*.

Here, the assist control indicates that the operations of the switching elements 41 are controlled by the ECU 40 such that electric power is supplied from the battery 50 to the rotary electric machine 30. In other words, the assist control indicates controlling the rotary electric machine 30 to rotate the crankshaft 14 within the power running rotation speed range Rd (a range of power running operation) and within the cranking rotation speed range Rc (within a dotted line region) shown in FIG. 6 when the engine 1 is started.

Even when the rotation speed N is equal to or higher than the rotation speed N2, the ECU 40 performs the power running rotation speed range expansion control of expanding the power running rotation speed range Rd in order to perform the assist control (power running operation). Specifically, when performing the assist control, the control circuit 42 performs the advance angle control on the rotary electric machine 30 in a state in which the crankshaft 14 is rotated at the rotation speed N within the cranking rotation speed range Rc to lower the induced voltage value Vi and expand the power running rotation speed range Rd. That is, the advance angle control is used to perform field weakening control to lower the induced voltage value Vi.

More specifically, when performing the assist control, the ECU 40 performs the advance angle control of switching the conduction phase to the rotary electric machine 30 from the first phase angle to a second phase angle larger than the first phase angle in a state in which the crankshaft 14 is rotated at the rotation speed within the cranking rotation speed range Rc so as to perform the power running rotation speed range expansion control to lower the induced voltage value Vi. The first phase angle is set as an advance angle of about 0 degrees, for example. The second phase angle is set as a predetermined conduction phase of an advance angle of about 60 degrees or more and about 80 degrees or less, for example. Furthermore, the ECU 40 switches the first phase angle to the second phase angle when the rotation speed N has changed from less than the switching rotation speed Nt to not less than the switching rotation speed Nt.

The ECU 40 performs control of switching a state in which three-phase alternating current power including a conduction period of about 120 electrical degrees is supplied to the rotary electric machine 30 to a state in which three-phase alternating current power including a conduction period of about 180 electrical degrees is supplied to the rotary electric machine 30, for example, in a state in which the crankshaft 14 is rotated at the rotation speed within the cranking rotation speed range Rc. Furthermore, the ECU 40 switches the conduction period of about 120 electrical degrees to the conduction period of about 180 electrical degrees when the rotation speed N has changed from less than the switching rotation speed Nt to not less than the switching rotation speed Nt. That is, the ECU 40 changes the conduction period from about 120 electrical degrees to about 180 electrical degrees and changes the conduction phase from the first phase angle to the second phase angle when the rotation speed N has changed from less than the switching rotation speed Nt to not less than the switching rotation speed Nt.

After performing the assist control and the power running rotation speed range expansion control to start the engine 1, the ECU 40 stops the power running rotation speed range expansion control and performs the power generation control in a state in which the rotation speed N is larger than the cranking rotation speed range Rc. The power generation control is a control of keeping the output voltage value Vb of the battery 50 constant by changing the conduction phase by the ECU 40. The conduction period is about 180 electrical degrees, for example.

When the output voltage value Vb of the battery 50 is less than the reference voltage value Vt, the ECU 40 does not perform the assist control and the power running rotation speed range expansion control and does not operate the switching elements 41 such that the rotation speed N is equal to or higher than the rotation speed N2 and the full-wave rectification state is established. Thus, alternating-current power from the rotary electric machine 30 is full-wave rectified by the body diodes included in the switching elements 41, and direct-current power is supplied to the battery 50, the ECU 40, and the engine auxiliaries 1*a*.

When the battery 50 is not in the assist control charge state and the engine 1 is started, the crankshaft 14 is rotated at the rotation speed N equal to or higher than the rotation speed N2 such that the ECU 40 is activated with electric power regenerated from the rotary electric machine 30.

In the outboard motor 100, electric power is supplied from the rotary electric machine 30 to the fuel injector 16, fuel is injected, electric power is supplied to the igniter 17, and the engine 1 is started.

Figure 10:
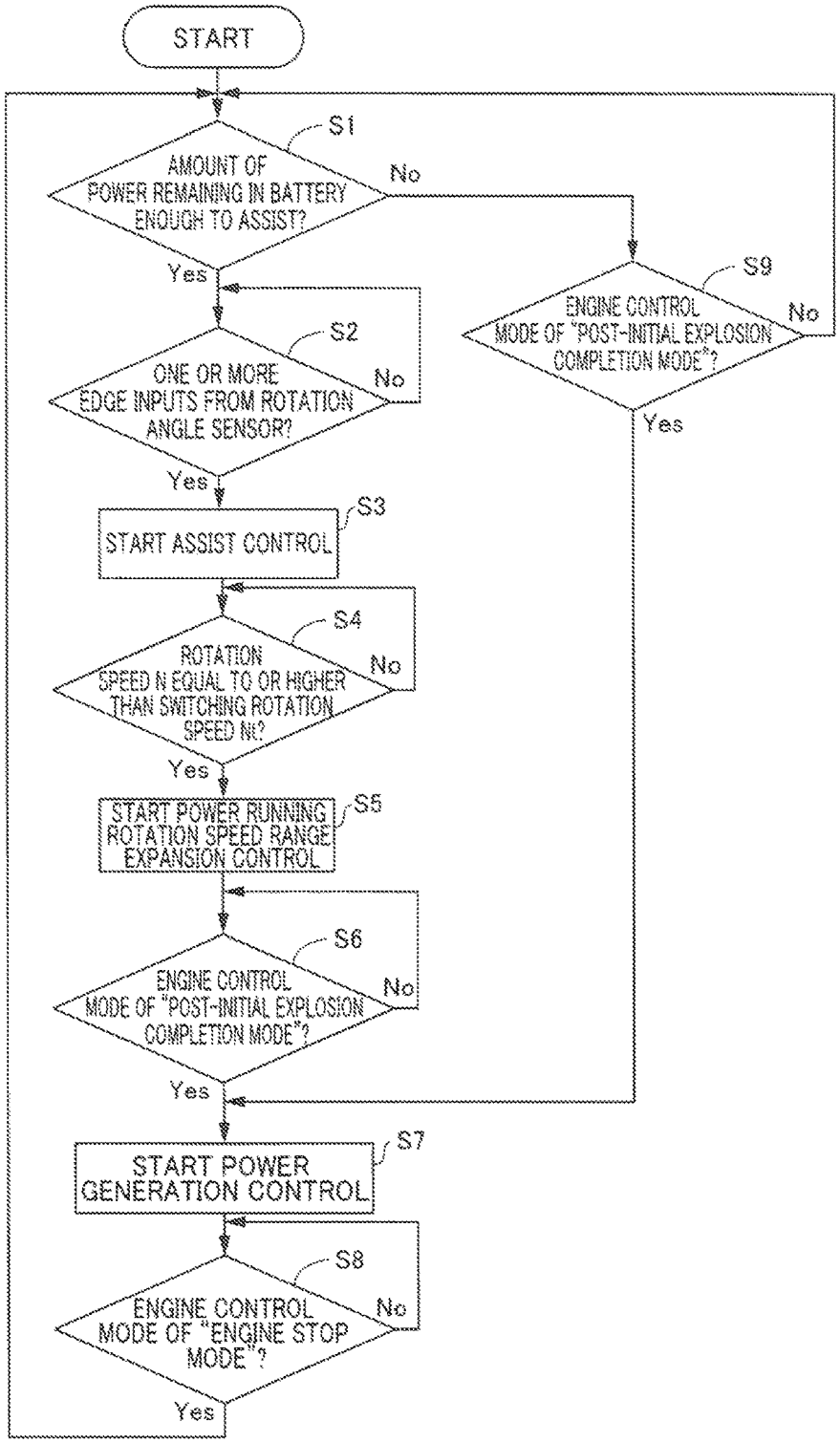
FIG. 10 is a flowchart illustrating rotary electric machine control processing of an ECU of an outboard motor according to a preferred embodiment of the present invention.
Figure 11:
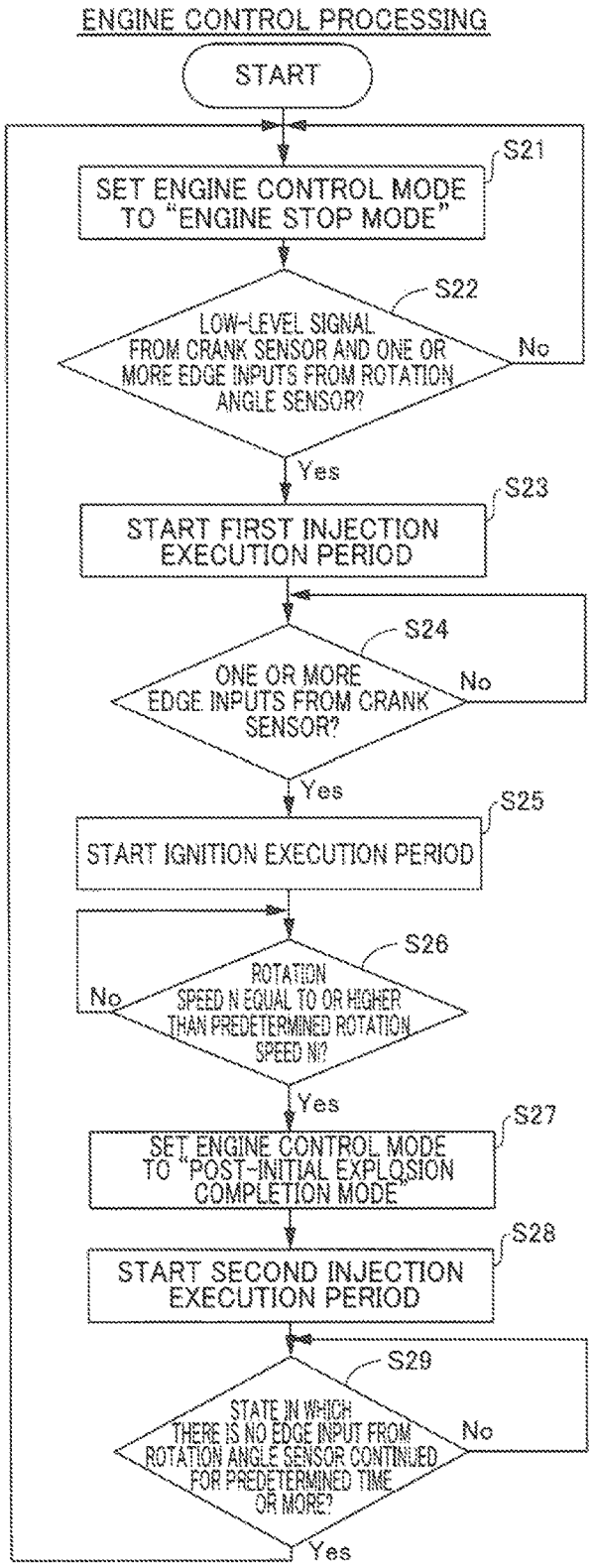
FIG. 11 is a flowchart illustrating engine control processing of an ECU of an outboard motor according to a preferred embodiment of the present invention.
Figure 12:
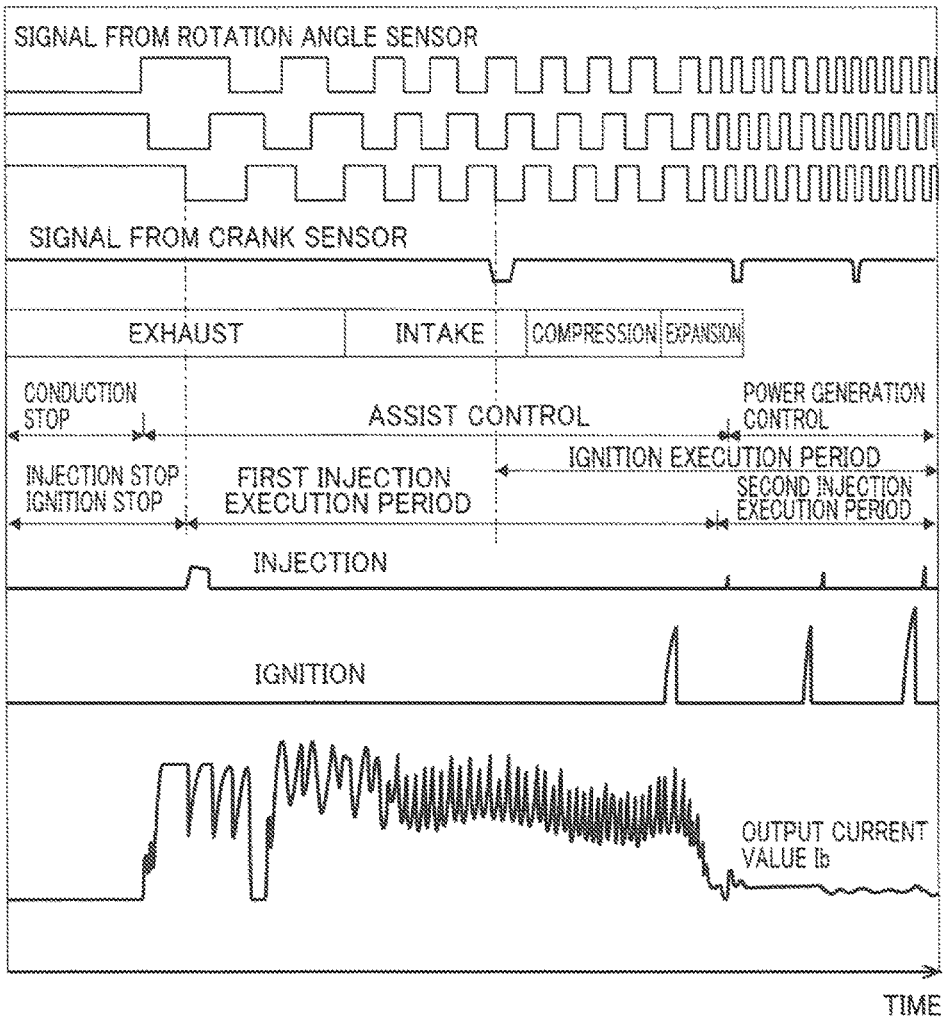
FIG. 12 is a diagram illustrating respective waveforms when assist control and power running rotation speed range expansion control are performed in an outboard motor according to a preferred embodiment of the present invention.

A method for starting the engine 1 of the outboard motor 100 according to a preferred embodiment of the present invention is now described with reference to FIGS. 2, 7, and 9 to 12. FIG. 10 is a flowchart illustrating rotary electric machine control processing performed by the control circuit 42 of the outboard motor 100. FIG. 11 is a flowchart illustrating engine control processing performed by the control circuit 42 of the outboard motor 100. FIG. 12 shows waveforms in the outboard motor 100 when the battery 50 is in the assist control charge state and the assist control and the power running rotation speed range expansion control are performed.

First, as shown in FIG. 7, the main switch 61 and the start switch 62 are turned on by the operator. Then, as shown in FIG. 2, the puller 2 is pulled by the operator, and the rope 22 wound around the rope reel 21 is pulled out. Accordingly, the rope reel 21 is rotated. When the rope reel 21 is rotated, the FWM 15 and the crankshaft 14 are rotated via the cam plate 23 etc. When the FWM 15 rotates, a change in the rotation angle is acquired by the rotation angle sensor 33, as shown in FIG. 12. Furthermore, the rotation speed N is acquired based on the change in the rotation angle.

When the battery 50 is charged, a change in the rotation angle at the start of rotation of the rope reel 21 is acquired in a state in which the ECU 40 is activated. On the other hand, when the battery 50 is not charged, the amount of power remaining in the battery 50 is less than the amount of electric power enough to activate the ECU 40, or the battery 50 is not connected to the ECU 40, the ECU 40 stops. In this case, rotation of the rope reel 21 is started, the switching elements 41 do not operate, the ECU 40 is in the full-wave rectification state, and using electric power regenerated from the rotary electric machine 30, direct-current power is supplied to the battery 50, the ECU 40, and the engine auxiliaries 1*a*. Then, when the ECU 40 is activated with the electric power from the rotary electric machine 30, the following rotary electric machine control processing and engine control processing are executed.

As shown in FIG. 10, in step S1, it is determined whether or not the amount of power remaining in the battery 50 is enough to assist the operator to start the engine 1. That is, it is determined whether or not the battery 50 is in the assist control charge state. When the amount of power remaining in the battery 50 is enough to assist the operator to start the engine 1, the processing advances to step S2, and when the amount of power remaining in the battery 50 is not enough to assist the operator to start the engine 1, the processing advances to step S9.

In step S2, it is determined whether or not the number of edge inputs from the rotation angle sensor 33 is one or more. This determination is repeated until the number of edge inputs from the rotation angle sensor 33 becomes one or more. When the number of edge inputs from the rotation angle sensor 33 is one or more, the processing advances to step S3.

In step S3, the assist control is started. Specifically, the switching elements 41 operate with the conduction period of about 120 electrical degrees and the first phase angle, and electric power is supplied from the battery 50 to the rotary electric machine 30. For example, as shown in FIG. 12, a value of an output current Ib that flows from the battery 50 to the rotary electric machine 30 increases. Thereafter, the processing advances to step S4.

In step S4, it is determined whether or not the rotation speed N is equal to or higher than the switching rotation speed Nt. This determination is repeated until the rotation speed N becomes equal to or higher than the switching rotation speed Nt. When the rotation speed N is equal to or higher than the switching rotation speed Nt, the processing advances to step S5.

In step S5, the power running rotation speed range expansion control is started. For example, the conduction period is changed from about 120 electrical degrees to about 180 electrical degrees, and the conduction phase is advanced from the first phase angle (about 0 degrees, for example) to the second phase angle (for example, advance angle about 60 degrees or advance angle about 80 degrees). Thereafter, the processing advances to step S6.

In step S6, it is determined whether or not the engine control mode is the "post-initial explosion completion mode". This determination is repeated until the engine control mode becomes the "post-initial explosion completion mode", and when the engine control mode is the "post-initial explosion completion mode", the processing advances to step S7.

In step S7, the power generation control is started. That is, the magnitude of regeneration power is controlled such that the conduction phase is changed, and the output voltage value Vb becomes a constant value. At this time, the conduction period is about 180 electrical degrees. Thereafter, the processing advances to step S8.

In step S8, it is determined whether or not the engine control mode is the "engine stop mode". This determination is repeated until the engine control mode becomes the "engine stop mode", and when the engine control mode is the "engine stop mode", the processing returns to step S1.

In step S9, to which the processing advances when it is determined in step S1 that the amount of power remaining in the battery 50 is not enough to assist the operator to start the engine 1, it is determined whether or not the engine control mode is the "post-initial explosion completion mode". When the engine control mode is not the "post-initial explosion completion mode", the processing returns to step S1. When the engine control mode is the "post-initial explosion completion mode", the processing advances to step S7.

As shown in FIG. 11, in step S21, the engine control mode is set to the "engine stop mode". Thereafter, the processing advances to step S22.

In step S22, it is determined whether or not a signal from the crank sensor 14*a* is at a low level and the number of edge inputs from the rotation angle sensor 33 is one or more. That is, it is determined whether or not a change in the rotation angle has been detected by the rotation angle sensor 33. When the battery 50 is in the assist control charge state, a change in the rotation angle at the start of rotation of the rope reel 21 is acquired in a state in which the ECU 40 is activated. On the other hand, when the battery 50 is not sufficiently charged, rotation of the rope reel 21 is started in a state in which the ECU 40 stops, and a change in the rotation angle at the activation of the ECU 40 is acquired with electric power regenerated from the rotary electric machine 30. When the number of edge inputs from the rotation angle sensor 33 is one or more, the processing advances to step S23. When the number of edge inputs from the rotation angle sensor 33 is not one or more, the processing returns to step S21.

In step S23, the first injection execution period is started. That is, when a change in the rotation angle is acquired from the rotation angle sensor 33 (when the number of edge inputs is one or more), the fuel injector 16 starts to be controlled to inject fuel asynchronously with the operation of the crankshaft 14. Thereafter, the processing advances to step S24.

In step S24, it is determined whether or not the number of edge inputs from the crank sensor 14*a* is one or more. This determination is repeated until the number of edge inputs from the crank sensor 14*a* becomes one or more, and when the number of edge inputs from the crank sensor 14*a* is one or more, the processing advances to step S25.

In step S25, the ignition execution period is started. Thereafter, the processing advances to step S26.

In step S26, it is determined whether or not the rotation speed N is equal to or higher than the predetermined rotation speed Ni. This determination is repeated until the rotation speed N becomes equal to or higher than the predetermined rotation speed Ni, and when the rotation speed N is equal to or higher than the predetermined rotation speed Ni, the processing advances to step S27. That is, when initial explosion occurs in the engine 1, the engine 1 is started, the rotation speed N is increased, and the processing advances to step S27.

In step S27, the engine control mode is set to the "post-initial explosion completion mode". Thereafter, the processing advances to step S28. In step S28, the second injection execution period is started. That is, the fuel injector 16 starts to be controlled to inject fuel synchronously with the operation of the crankshaft 14. Thereafter, the processing advances to step S29.

In step S29, it is determined whether or not a state in which there is no edge input from the rotation angle sensor 33 has continued for the predetermined time or more. This determination is repeated until a state in which there is no edge input from the rotation angle sensor 33 has continued for the predetermined time or more. When a state in which there is no edge input from the rotation angle sensor 33 has continued for the predetermined time or more, the processing returns to step S21.

Results of comparison between the outboard motor 100 according to a preferred embodiment of the present invention and an outboard motor according to a comparative example are now described with reference to FIGS. 4 and 13.

Figure 13:
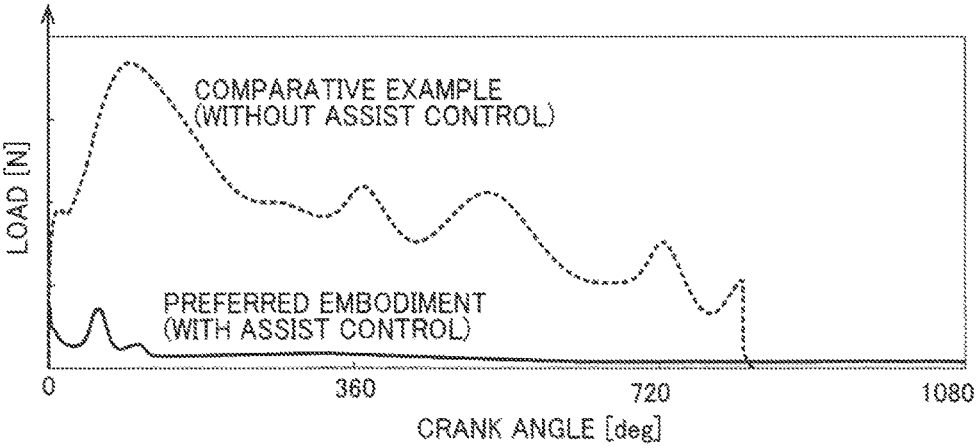
FIG. 13 is a diagram showing comparison results between a load required to pull a rope in an outboard motor according to a preferred embodiment of the present invention and a load required to pull a rope in an outboard motor according to a comparative example.

As shown in FIG. 13, a load required to pull the rope 22 when the assist control and the power running rotation speed range expansion control are performed by the outboard motor 100 according to a preferred embodiment of the present invention and a load required to pull a rope in the outboard motor according to the comparative example that does not perform the assist control and the power running rotation speed range expansion control were measured. Specifically, the magnitude of a load corresponding to a crank angle (up to about 800 degrees) when the rope was pulled from a 0-degree crank angle was measured.

As shown in FIG. 13, the load of the outboard motor 100 according to a preferred embodiment of the present invention was smaller than the load of the outboard motor according to the comparative example at any point from a 0-degree crank angle to an 800-degree crank angle. From this result, it has been discovered that the load required when the operator pulls the rope 22 is decreased by performing the assist control and the power running rotation speed range expansion control.

As shown in FIG. 4, a pressure P1 inside the cylinders 11 (in-cylinder pressure) when the engine 1 is started by pulling the rope 22 while performing the assist control and the power running rotation speed range expansion control in the outboard motor 100 according to a preferred embodiment of the present invention and a pressure P2 inside cylinders when an engine is manually started in the outboard motor according to the comparative example that does not perform the assist control and the power running rotation speed range expansion control were measured.

In the outboard motor according to the comparative example, the rope was pulled from a 130-degree crank angle, and the pressure P2 inside the cylinders did not increase at the position of the first compression stroke (in the vicinity of a 360-degree crank angle) or did not exceed an initial explosion possible pressure Pt. Therefore, in the outboard motor according to the comparative example, the engine was not started at the position of the first compression stroke. After that, in the second compression stroke, which was reached by continuously pulling the rope, the pressure P2 inside the cylinders increased and exceeded the initial explosion possible pressure Pt, and the engine started.

On the other hand, in the outboard motor 100 according to a preferred embodiment of the present invention, the rope 22 was pulled from a 130-degree crank angle, the crankshaft 14 was rotated by the assist control and the power running rotation speed range expansion control, and at the position of the first compression stroke (in the vicinity of a 360-degree crank angle), the pressure P1 inside the cylinders 11 exceeded the initial explosion possible pressure Pt, and initial explosion occurred. Thus, the engine 1 started. In addition, in the outboard motor 100 according to a preferred embodiment of the present invention, the crankshaft 14 was continuously rotated by the engine 1 and the rotary electric machine 30 even after the initial explosion, and even in second and subsequent compression strokes, the pressure P1 inside the cylinders 11 exceeded the initial explosion possible pressure Pt.

Therefore, it has been discovered that the initial explosion occurs in the first compression stroke in the outboard motor 100 according to a preferred embodiment of the present invention unlike the outboard motor according to the comparative example.

According to the various preferred embodiments of the present invention described above, the following advantageous effects are achieved.

According to a preferred embodiment of the present invention, the ECU 40 is configured or programmed to perform the assist control of assisting rotation of the crankshaft 14 by the rotary electric machine 30 in a state in which the crankshaft 14 is rotated at the rotation speed N within the cranking rotation speed range Rc (hereinafter referred to as the "range Rc") due to rotation of the rope reel 21. Accordingly, when the operator pulls the rope 22 to rotate the rope reel 21, the rotary electric machine 30 assists in rotation of the crankshaft 14, and thus a torque from the rotary electric machine 30 is applied to the crankshaft 14, and a force (load) of pulling the rope 22 required to exceed a resistance on the compression stroke of the engine 1 is decreased. This advantageous effect is confirmed by the above comparison results. In addition, unlike the case in which an accumulation power spring is provided, a preliminary operation of winding an accumulation power spring in advance is not necessary, and thus the work burden of starting the engine 1 on the operator is decreased.

According to a preferred embodiment of the present invention, the rotary electric machine 30 assists in rotation of the crankshaft 14 such that even when the force of the operator to pull the rope 22 is relatively small, the rotation speed N of the crankshaft 14 is increased. Consequently, the pressure inside the cylinders 11 of the engine 1 is increased due to the increased rotation speed N of the crankshaft 14, and thus the possibility that initial explosion occurs in the engine 1 is increased, and the engine 1 is more reliably started.

According to a preferred embodiment of the present invention, the ECU 40 is configured or programmed to perform the power running rotation speed range expansion control of expanding the power running rotation speed range Rd of the rotary electric machine 30 in a state in which the crankshaft 14 is rotated at the rotation speed N within the range Rc. Accordingly, when the rotary electric machine 30 is designed such that the induced voltage value Vi of the rotary electric machine 30 exceeds the output voltage value Vb of the battery 50 within the range Rc, that is, even when the upper limit value N1*b* of the cranking rotation speed range Rc is larger than the upper limit value N2 of the power running rotation speed range Rd, the power running rotation speed range Rd is expanded by the power running rotation speed range expansion control such that the rotary electric machine 30 performs the power running operation. Consequently, when the power running rotation speed range expansion control is not performed (when the conduction regeneration control is performed or in the full-wave rectification state), electric power is returned from the rotary electric machine 30 to the battery 50 within the range Rc, and when the power running rotation speed range expansion control is performed, the induced voltage value Vi is lowered below the output voltage value Vb of the battery 50 within the range Rc, and the assist control is performed. Consequently, even when electric power is not supplied from the battery 50, the operator pulls the rope 22 to rotate the rope reel 21 and rotate the crankshaft 14 at the rotation speed within the range Rc such that using the electric power returned from the rotary electric machine 30, the fuel injector 16 and the igniter 17 operate to start the engine 1. Therefore, a state in which the engine 1 is reliably and quickly started is maintained while the work burden of starting the engine 1 is decreased. That is, even in the case when the amount of power remaining in the battery 50 is not enough to assist the operator to start the engine 1, the fuel injection actuators operate to start the engine 1.

According to a preferred embodiment of the present invention, the rotary electric machine 30 includes the power generation rotation speed range Rg, which is the range of the rotation speed N of the crankshaft 14 within which the induced voltage value Vi is not less than the output voltage value Vb of the battery 50, that overlaps with the range Rc in a state in which the power running rotation speed range expansion control is not performed by the ECU 40. Furthermore, the ECU 40 is configured or programmed to, in a state in which the crankshaft 14 is rotated at the rotation speed N at least within the overlapping rotation speed range, perform the power running rotation speed range expansion control to lower the induced voltage value Vi below the output voltage value Vb and perform the assist control. Accordingly, when the crankshaft 14 is rotated at the rotation speed N within the overlapping rotation speed range, and the power running rotation speed range expansion control is not performed, electric power is returned from the rotary electric machine 30 to the battery 50. When the crankshaft 14 is rotated at the rotation speed N within the overlapping rotation speed range, and the power running rotation speed range expansion control is performed, the assist control is easily performed.

According to a preferred embodiment of the present invention, the ECU 40 is configured or programmed to perform the assist control and the power running rotation speed range expansion control when the battery 50 is in the assist control charge state. Accordingly, when the battery 50 is sufficiently charged with electric power and the electric power of the battery 50 is usable, the power running rotation speed range Rd of the rotary electric machine 30 is expanded by the power running rotation speed range expansion control such that the rotary electric machine 30 assists in rotation of the crank shaft 14.

According to a preferred embodiment of the present invention, when the battery 50 is not in the assist control charge state, and the crank shaft 14 is rotated at the rotation speed N within the range Rc due to rotation of the rope reel 21, electric power is regenerated from the rotary electric machine 30. Accordingly, when the battery 50 is not charged with electric power, and the assist control is not possible, the rope reel 21 is rotated such that the crankshaft 14 is rotated at the rotation speed N within the range Rc so as to regenerate and supply electric power to operate the fuel injector 16 and the igniter 17 and further to charge the battery 50. That is, the rope reel 21 is rotated such that the fuel injector 16, etc. immediately operate with the regenerated electric power.

According to a preferred embodiment of the present invention, the fuel injection actuators related to FI is provided in the outboard motor 100, and electric power from the rotary electric machine 30 is supplied to the fuel injection actuators related to FI and the ECU 40 when the battery 50 is not in the assist control charge state, and the crankshaft 14 is rotated at the rotation speed N within the cranking rotation speed range Rc due to rotation of the rope reel 21. Accordingly, even when the battery 50 is not in the assist control charge state, the fuel injection actuators related to FI and the ECU 40 are driven with the electric power regenerated from the rotary electric machine 30 when the ECU 40 is in the full-wave rectification state, for example, to start the engine 1.

According to a preferred embodiment of the present invention, the ECU 40 is configured or programmed to be activated with electric power from the rotary electric machine 30 when the battery 50 is not in the assist control charge state, and the crankshaft 14 is rotated at the rotation speed N within the range Rc due to rotation of the rope reel 21. Accordingly, even when the battery 50 is not in the assist control charge state, the rope reel 21 is rotated to activate the ECU 40. Consequently, even when the battery 50 is not in the assist control charge state, the ECU 40 is activated to appropriately control the operation of the rotary electric machine 30.

According to a preferred embodiment of the present invention, the ECU 40 is configured or programmed to perform the assist control and the power running rotation speed range expansion control when the output voltage value Vb supplied from the battery 50 is equal to or larger than the reference voltage value Vt as when the battery 50 is in the assist control charge state. Accordingly, the output voltage value Vb supplied from the battery 50 is compared with the reference voltage value Vt such that it is easily determined whether or not the battery 50 is in the assist control charge state, and when the battery 50 is sufficiently charged with electric power, the assist control is performed.

According to a preferred embodiment of the present invention, the ECU 40 is configured or programmed to start the power running rotation speed range expansion control upon change of the rotation speed N of the crankshaft 14 from less than the switching rotation speed Nt to not less than the switching rotation speed Nt within the range Rc when performing the assist control. Accordingly, when the rotation speed N of the crankshaft 14 is less than the switching rotation speed Nt, the rotary electric machine 30 is rotated to increase the torque without performing the power running rotation speed range expansion control, and when the rotation speed N is not less than the switching rotation speed Nt such that the torque is decreased due to the increased induced voltage value Vi, the rotary electric machine 30 is rotated to increase the torque with performing the power running rotation speed range expansion control. Consequently, even when the crankshaft 14 is rotated at any rotation speed N, the torque is increased, and thus the rotary electric machine 30 efficiently assists in rotation of the crankshaft 14.

According to a preferred embodiment of the present invention, the ECU 40 is configured or programmed to, when performing the assist control, perform the advance angle control on the rotary electric machine 30 in a state in which the crankshaft 14 is rotated at the rotation speed within the range Rc so as to perform the power running rotation speed range expansion control to lower the induced voltage value Vi. Accordingly, the induced voltage value Vi of the rotary electric machine 30 is lowered in response to a change in the conduction phase of electric power to be supplied to the rotary electric machine 30, and thus the power running rotation speed range expansion control is easily performed.

According to a preferred embodiment of the present invention, the ECU 40 is configured or programmed to, when performing the assist control, perform control of switching the conduction phase to the rotary electric machine 30 from the first phase angle to the second phase angle larger than the first phase angle in a state in which the crankshaft 14 is rotated at the rotation speed within the range Rc so as to perform the power running rotation speed range expansion control to lower the induced voltage value Vi. Accordingly, the conduction phase to the rotary electric machine 30 is switched such that the induced voltage value Vi is lowered. Therefore, the conduction phase to the rotary electric machine 30 is advanced (switched) from the first phase angle to the second phase angle such that the power running rotation speed range expansion control is easily performed.

According to a preferred embodiment of the present invention, the rotary electric machine 30 rotates with three-phase alternating current power supplied to the rotary electric machine 30. Furthermore, the ECU 40 is configured or programmed to perform the assist control while supplying the three-phase alternating current power including the conduction period of about 180 electrical degrees larger than about 120 electrical degrees to the rotary electric machine 30 in a state in which the crankshaft 14 is rotated at the rotation speed N within the range Rc. Accordingly, the power running rotation speed range is further expanded.

According to a preferred embodiment of the present invention, the ECU 40 is configured or programmed to perform the assist control while supplying the three-phase alternating current power including the conduction period of about 120 electrical degrees to the rotary electric machine 30 in a state in which the crankshaft 14 is rotated at the rotation speed N less than the switching rotation speed Nt within the range Rc, and is configured or programmed to perform the assist control while supplying the three-phase alternating current power including the conduction period of about 180 electrical degrees to the rotary electric machine 30 in a state in which the crankshaft 14 is rotated at the rotation speed not less than the switching rotation speed Nt within the range Rc. Accordingly, when the crankshaft 14 is rotated at the rotation speed N less than the switching rotation speed Nt at which the induced voltage value Vi is relatively small, the conduction period is set to about 120 electrical degrees such that more efficient assist control is performed, and when the crankshaft 14 is rotated at the rotation speed N not less than the switching rotation speed Nt at which the induced voltage value Vi is relatively large, the conduction period is changed to the conduction period of about 180 electrical degrees such that the power running rotation speed range Rd is expanded, and the assist control is performed while significantly reducing or preventing a decrease in torque.

According to a preferred embodiment of the present invention, the ECU 40 is configured or programmed to, in a state in which the crankshaft 14 is rotated at the rotation speed N larger than the range Rc, stop the power running rotation speed range expansion control and perform the power generation control. Accordingly, when the engine 1 is started and the crankshaft 14 is rotated at the rotation speed N larger than the range Rc, the output voltage value Vb of the battery 50 is constant, and thus electric power is appropriately supplied to the engine auxiliaries 1*a* including the fuel injector 16 and the igniter 17 while the battery 50 is charged.

According to a preferred embodiment of the present invention, the outboard motor 100 includes the rotation angle sensor 33 that acquires the rotation angle of the rotary electric machine 30. Furthermore, the ECU 40 is configured or programmed to divert, to the power running rotation speed range expansion control and the assist control, the rotation angle necessary for the conduction control of the rotary electric machine 30 and detected by the rotation angle sensor 33. Accordingly, it is not necessary for the operator to perform an input operation when the assist control is started, and thus an operation of starting the engine 1 becomes simpler.

According to a preferred embodiment of the present invention, the ECU 40 is configured or programmed to, after the rotation speed N of the crankshaft 14 exceeds the rotation speed of the rope reel 21, continue to perform the power running rotation speed range expansion control and perform control of supplying electric power from the battery 50 to the rotary electric machine 30 to rotate the crankshaft 14. Accordingly, even when the operator cannot perform a cranking operation enough to start the engine 1, the engine 1 is started while the crankshaft 14 is continuously rotated by the rotary electric machine 30. Consequently, the length of the rope 22 is decreased.

According to a preferred embodiment of the present invention, the engine 1 includes the fuel injector 16 and the igniter 17. Furthermore, the ECU 40 is configured or programmed to, at least until fuel injection by the fuel injector 16 is completed and initial ignition by the igniter 17 is completed, continue to perform the power running rotation speed range expansion control and perform control of supplying electric power from the battery 50 to the rotary electric machine 30 in a state in which the crankshaft 14 is rotated at the rotation speed N within the range Rc. Accordingly, the rotary electric machine 30 assists in rotation of the crankshaft 14 at least until ignition is performed in the engine 1, and thus the engine 1 is more reliably started.

According to a preferred embodiment of the present invention, the rotary electric machine 30 includes the FWM 15 directly connected to the crankshaft 14 and the stator 32 that faces the permanent magnets 31 in the radial direction of the crankshaft 14. Accordingly, unlike the case in which the rotary electric machine and the crankshaft are not directly connected to each other, as the case in which a gear or the like is provided between the rotary electric machine and the crankshaft, a complicated configuration of the outboard motor 100 is significantly reduced or prevented. Furthermore, with the above configuration, an existing rotary electric machine 30 provided in a conventional outboard motor is usable as the rotary electric machine 30 that assists in rotation of the crankshaft 14.

According to a preferred embodiment of the present invention, the battery 50 that supplies electric power to the rotary electric machine 30 and to which electric power is returned from the rotary electric machine 30 is disposed in the outboard motor 100. Accordingly, there is no need to provide a power line through which electric power is exchanged between the marine vessel and the outboard motor 100 unlike the case in which electric power is supplied from the battery provided in the marine vessel (vessel body) to the rotary electric machine. Consequently, the structure that connects the outboard motor 100 to the marine vessel is simplified.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the rotary electric machine 30 is preferably directly connected to the crankshaft 14 in preferred embodiments described above, the present invention is not restricted to this. For example, a gear may alternatively be provided on a flywheel, and the rotary electric machine 30 may alternatively be connected to the crankshaft 14 via the gear.

While the ECU 40 is preferably configured or programmed to perform the power running rotation speed range expansion control when the rotation speed N of the crankshaft 14 is equal to or higher than the switching rotation speed Nt in preferred embodiments described above, the present invention is not restricted to this. For example, the ECU 40 may alternatively be configured or programmed to perform the power running rotation speed range expansion control at the start of the assist control (when the rotation speed N is approximately zero).

While upon a change of the rotation speed N from less than the switching rotation speed Nt to not less than the switching rotation speed Nt, the first phase angle is switched to the second phase angle, and the conduction period is switched from about 120 electrical degrees to about 180 electrical degrees in preferred embodiments described above, the present invention is not restricted to this. For example, upon change of the rotation speed N from less than a first switching rotation speed Nt1 to not less than the first switching rotation speed Nt1, the first phase angle may alternatively be switched to the second phase angle, and upon a change of the rotation speed N from less than a second switching rotation speed Nt2 different from the first switching rotation speed Nt1 to not less than the second switching rotation speed Nt2, the conduction period may alternatively be switched from about 120 electrical degrees to about 180 electrical degrees.

While the ECU 40 is preferably configured or programmed to start the assist control based on a change in the rotation angle of the rotation angle sensor 33 in preferred embodiments described above, the present invention is not restricted to this. For example, a switch (lever) or the like that starts the assist control may alternatively be provided on the puller 2 of the outboard motor 100, and the ECU 40 may alternatively be configured or programmed to start the assist control when the operator operates the switch (lever) or the like.

While the second phase angle in the power running rotation speed range expansion control is preferably set as an advance angle of about 60 degrees or more and about 80 degrees or less, for example, and the conduction period in the power running rotation speed range expansion control is preferably set as the conduction period of about 180 electrical degrees in preferred embodiments described above, the present invention is not restricted to this. That is, the second phase angle may alternatively be set as an advance angle of less than about 60 degrees or more than about 80 degrees, and the conduction period in the power running rotation speed range expansion control may alternatively be set as a conduction period of more than about 120 electrical degrees other than about 180 electrical degrees.

While in the power running rotation speed range expansion control, the first phase angle is preferably switched to the second phase angle at once in preferred embodiments described above, the present invention is not restricted to this. That is, in the power running rotation speed range expansion control, the conduction phase may alternatively be gradually advanced from the first phase angle to the second phase angle according to an increase in the rotation speed N.

While the battery 50 is preferably disposed in the outboard motor 100 in preferred embodiments described above, the present invention is not restricted to this. That is, the battery may alternatively be disposed in the vessel body 101 (marine vessel).

Figure 14:
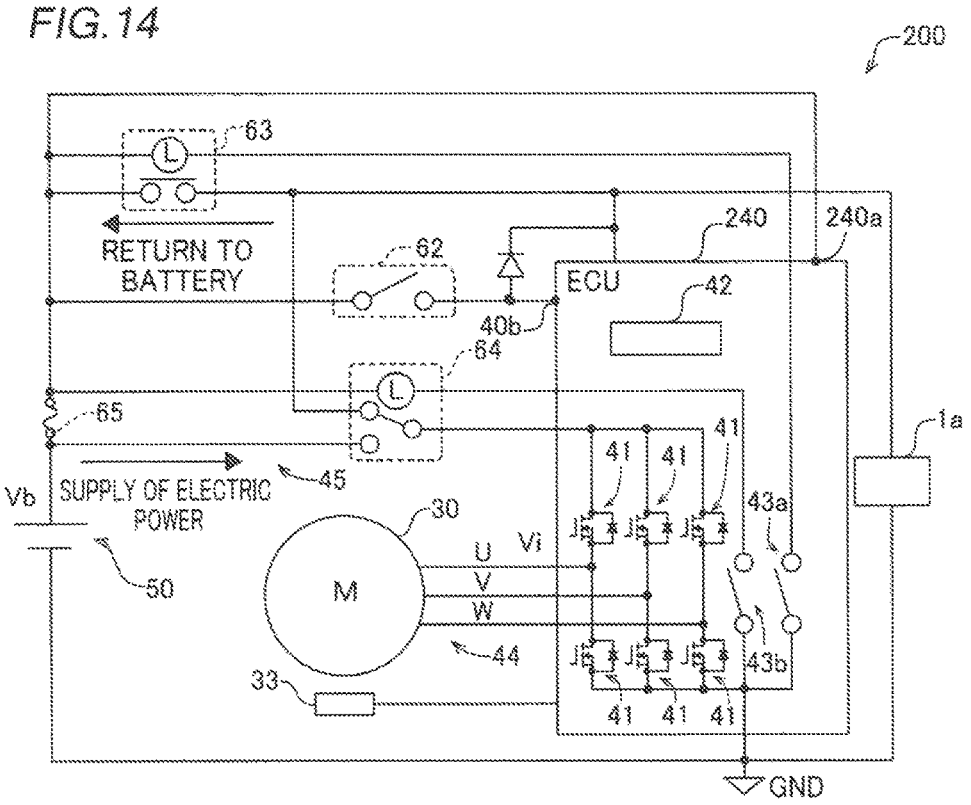
FIG. 14 is a circuit diagram illustrating the structure of an outboard motor according to a first modified preferred embodiment of the present invention.

While the main switch 61 is preferably provided in the outboard motor 100 in preferred embodiments described above, the present invention is not restricted to this. For example, as in an outboard motor 200 according to a first modified preferred embodiment shown in FIG. 14, a battery 50 and a power supply terminal 240*a* of an ECU 240 may be directly connected to each other by wiring. In this case, electric power is constantly supplied from the battery 50 to the power supply terminal 240*a* of the ECU 240. Thus, in the outboard motor 200 according to the first modified preferred embodiment, a main switch 61 is not provided such that the configuration is simplified.

Figure 15:
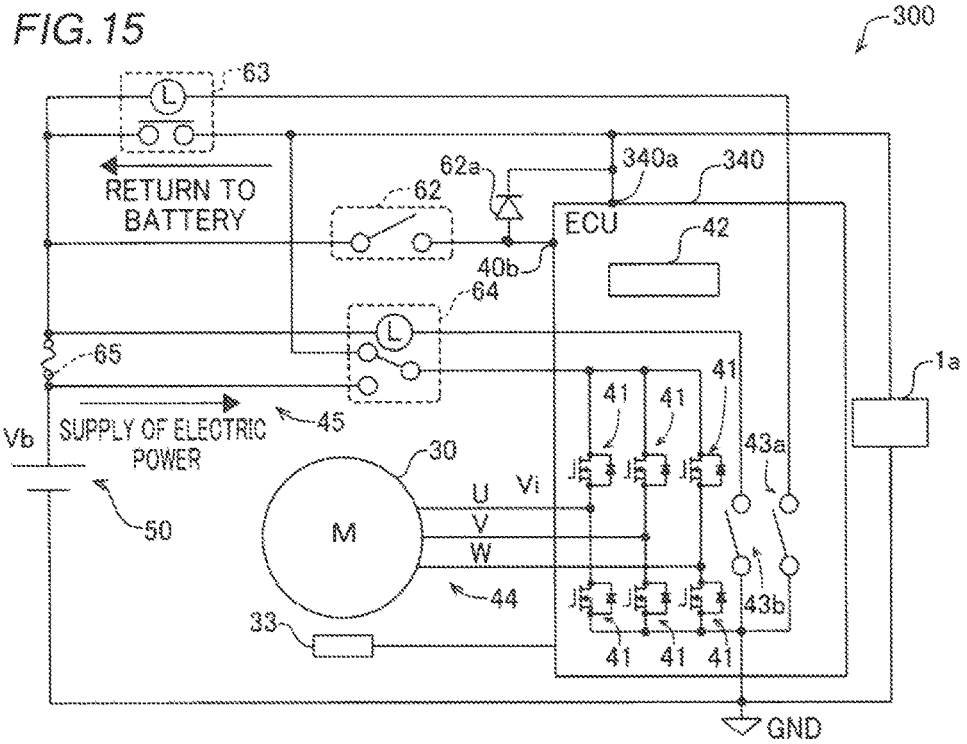
FIG. 15 is a circuit diagram illustrating the structure of an outboard motor according to a second modified preferred embodiment of the present invention.

As in an outboard motor 300 according to a second modified preferred embodiment shown in FIG. 15, a battery 50 and an ECU 340 may not be directly connected to each other unlike the outboard motor 200 according to the first modified preferred embodiment. In this case, electric power is supplied from the battery 50 to a power supply terminal 340*a* of the ECU 340 via a start switch 62 and a diode 62*a*. Thus, in the outboard motor 300 according to the second modified preferred embodiment, a main switch 61 is not provided such that the structure is simplified. Furthermore, electric power is not constantly supplied, and thus the dark current of the battery 50 is significantly reduced or prevented, and an increase in the size of the battery 50 is significantly reduced or prevented.

While the ECU 40 preferably includes the control circuit 42 and the switching elements 41 in preferred embodiments described above, the present invention is not restricted to this. For example, the control circuit 42 and the switching elements 41 may alternatively be disposed separately from the ECU 40 in the outboard motor 100.

While preferred embodiments of the present invention are preferably applied to the engine starter that starts the engine 1 of the outboard motor 100 in preferred embodiments described above, the present invention is not restricted to this. Preferred embodiments of the present invention may alternatively be applied to an engine starter that starts an engine of a vehicle, a motorcycle, or a snowmobile, or an engine disposed in the marine vessel, for example.

While the manual starter 20 preferably includes the rope reel 21 around which the rope 22 is wound in preferred embodiments described above, the present invention is not restricted to this. For example, the manual starter may alternatively include a kick lever connected to the crankshaft, and the manual starter may alternatively be configured as a kick starter.

Figure 16:
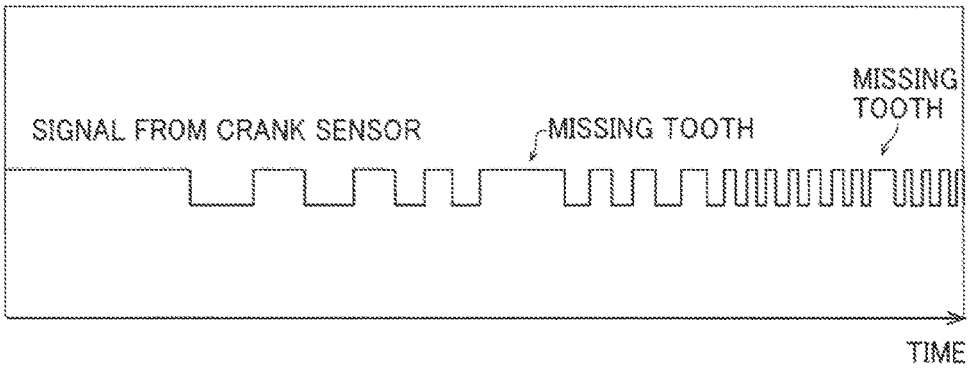
FIG. 16 is a circuit diagram illustrating the structure of an outboard motor according to a third modified preferred embodiment of the present invention.

While in order to detect the crank angle, one protrusion is preferably provided on the outer periphery of the FWM 15, and the low-level signal output from the crank sensor 14*a* once per rotation of the FWM 15 and the signal from the rotation angle sensor 33 are preferably used, as shown in FIG. 12, in preferred embodiments described above, the present invention is not restricted to this. For example, as in a third modified preferred embodiment shown in FIG. 16, eleven protrusions, for example, may be disposed at angular intervals of about 30 degrees, for example, on the outer periphery of the FWM (rotor) such that a missing tooth is detected. Thus, a reference position (the position of the missing tooth) and a predetermined angular resolution (about 30 degrees) are detected using only one waveform from the crank sensor, and thus the crank angle is detected.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a crankshaft and that starts when the crankshaft is rotated at a cranking rotation speed or higher;

a rope reel around which a rope is wound and connected to the crankshaft;

a rotary electric machine connected to the crankshaft; and a rotary electric machine controller configured or programmed to control the rotary electric machine; wherein the rotary electric machine controller is configured or programmed to, in a state in which the crankshaft is rotated at a rotation speed within a cranking rotation speed range including the cranking rotation speed due to rotation of the rope reel, perform assist control of assisting rotation of the crankshaft by the rotary electric machine and perform power running rotation speed range expansion control of expanding a power running rotation speed range of the rotary electric machine.

2. The outboard motor according to claim 1, wherein the rotary electric machine includes a power generation rotation speed range, which is a range of the rotation speed of the crankshaft within which an induced voltage value is not less than an output voltage value of a battery, that overlaps with the cranking rotation speed range in a state in which the power running rotation speed range expansion control is not performed by the rotary electric machine controller; and the rotary electric machine controller is configured or programmed to, in a state in which the crankshaft is rotated at the rotation speed at least within the overlapping rotation speed range, perform the power running rotation speed range expansion control to lower the induced voltage value below the output voltage value and perform the assist control.

3. The outboard motor according to claim 1, wherein the rotary electric machine controller is configured or programmed to perform the assist control and the power running rotation speed range expansion control when a battery is in an assist control charge state in which the battery is sufficiently charged to perform the assist control.

4. The outboard motor according to claim 3, wherein, when the battery is not in the assist control charge state, and the crankshaft is rotated at the rotation speed within the cranking rotation speed range due to the rotation of the rope reel, electric power is regenerated from the rotary electric machine.

5. The outboard motor according to claim 3, wherein the engine includes a fuel injection actuator;

the outboard motor further includes a drive controller configured or programmed to control driving of the fuel injection actuator; and when the battery is not in the assist control charge state, and the crankshaft is rotated at the rotation speed within the cranking rotation speed range due to the rotation of the rope reel, electric power is supplied from the rotary electric machine to the fuel injection actuator and the drive controller.

6. The outboard motor according to claim 3, wherein the rotary electric machine controller is configured or programmed to be activated with electric power from the rotary electric machine when the battery is not in the assist control charge state, and the crankshaft is rotated at the rotation speed within the cranking rotation speed range due to the rotation of the rope reel.

7. The outboard motor according to claim 3, wherein the rotary electric machine controller is configured or programmed to perform the assist control and the power running rotation speed range expansion control when a value of a voltage supplied from the battery is equal to or larger than a predetermined voltage value as when the battery is in the assist control charge state.

8. The outboard motor according to claim 1, wherein the rotary electric machine controller is configured or programmed to start the power running rotation speed range expansion control upon a change of the rotation speed of the crankshaft from less than a first rotation speed to not less than the first rotation speed within the cranking rotation speed range when performing the assist control.

9. The outboard motor according to claim 1, wherein the rotary electric machine controller is configured or programmed to, when performing the assist control, perform advance angle control on the rotary electric machine in the state in which the crankshaft is rotated at the rotation speed within the cranking rotation speed range so as to perform the power running rotation speed range expansion control to lower an induced voltage value of the rotary electric machine.

10. The outboard motor according to claim 9, wherein the rotary electric machine controller is configured or programmed to, when performing the assist control, perform control of switching a conduction phase to the rotary electric machine from a first phase angle to a second phase angle larger than the first phase angle in the state in which the crankshaft is rotated at the rotation speed within the cranking rotation speed range so as to perform the power running rotation speed range expansion control to lower the induced voltage value.

11. The outboard motor according to claim 1, wherein the rotary electric machine rotates with three-phase alternating current power supplied to the rotary electric machine; and the rotary electric machine controller is configured or programmed to perform the assist control while supplying the three-phase alternating current power including a first conduction period of more than about 120 electrical degrees to the rotary electric machine in the state in which the crankshaft is rotated at the rotation speed within the cranking rotation speed range.

12. The outboard motor according to claim 11, wherein the rotary electric machine controller is configured or programmed to perform the assist control while supplying the three-phase alternating current power including a second conduction period of not more than about 120 electrical degrees to the rotary electric machine in a state in which the crankshaft is rotated at the rotation speed less than a second rotation speed within the cranking rotation speed range, and is configured or programmed to perform the assist control while supplying the three-phase alternating current power including the first conduction period to the rotary electric machine in a state in which the crankshaft is rotated at the rotation speed not less than the second rotation speed within the cranking rotation speed range.

13. The outboard motor according to claim 1, wherein the rotary electric machine controller is configured or programmed to, in a state in which the crankshaft is rotated at the rotation speed larger than the cranking rotation speed range, stop the power running rotation speed range expansion control and perform power generation control.

14. The outboard motor according to claim 1, further comprising a rotation angle acquirer that acquires a rotation angle of the rotary electric machine.

15. The outboard motor according to claim 1, wherein the rotary electric machine controller is configured or programmed to, after the rotation speed of the crankshaft exceeds a rotation speed of the rope reel, continue to perform the power running rotation speed range expansion control and perform control of supplying electric power from a battery to the rotary electric machine to rotate the crankshaft.

16. The outboard motor according to claim 1, wherein the engine includes a fuel injector and an igniter; and the rotary electric machine controller is configured or programmed to, at least until fuel injection by the fuel injector is completed and initial ignition by the igniter is completed, continue to perform the power running rotation speed range expansion control and perform control of supplying electric power from a battery to the rotary electric machine in the state in which the crankshaft is rotated at the rotation speed within the cranking rotation speed range.

17. The outboard motor according to claim 1, wherein the rotary electric machine includes a rotor directly connected to the crankshaft and a stator that faces the rotor in a radial direction of the crankshaft.

18. The outboard motor according to claim 1, further comprising a battery disposed in an outboard motor body, that supplies electric power to the rotary electric machine, and to which the electric power is returned from the rotary electric machine.

19. An engine starter comprising:

a manual starter connected to a crankshaft of an engine that starts when the crankshaft is rotated at a cranking rotation speed or higher and that manually rotates the crankshaft;

a rotary electric machine connected to the crankshaft; and a rotary electric machine controller configured or programmed to control the rotary electric machine; wherein the rotary electric machine controller is configured or programmed to, in a state in which the crankshaft is rotated at a rotation speed within a cranking rotation speed range including the cranking rotation speed by the manual starter, perform assist control of assisting rotation of the crankshaft by the rotary electric machine and perform power running rotation speed range expansion control of expanding a power running rotation speed range of the rotary electric machine.

20. An engine starting method for an engine that starts when a crankshaft is rotated at a cranking rotation speed or higher, the method comprising:

rotating the crankshaft by a manual starter connected to the crankshaft; and performing assist control of assisting rotation of the crankshaft by a rotary electric machine connected to the crankshaft and performing power running rotation speed range expansion control of expanding a power running rotation speed range of the rotary electric machine in a state in which the crankshaft is rotated by the manual starter at a rotation speed within a cranking rotation speed range including the cranking rotation speed.

* * * * *